United States Patent [19]

Takeshima et al.

[11] Patent Number: 4,489,771

[45] Date of Patent: Dec. 25, 1984

[54] GAS-VENTING ARRANGEMENT INCORPORATED WITH A MOLD

[75] Inventors: Takahiko Takeshima; Tadashi Ueki; Motozo Kawashima, all of Ube; Thuneo Ueno, Shimonoseki; Masayuki Nishimoto, Ube, all of Japan

[73] Assignee: UBE Industries, Ltd., Yamaguchi, Japan

[21] Appl. No.: 322,364

[22] Filed: Nov. 17, 1981

[30] Foreign Application Priority Data

| | | | |
|---|---|---|---|
| Nov. 20, 1980 | [JP] | Japan | 55-163829 |
| Nov. 20, 1980 | [JP] | Japan | 55-163830 |
| Dec. 23, 1980 | [JP] | Japan | 55-181334 |
| Jun. 12, 1981 | [JP] | Japan | 56-90296 |

[51] Int. Cl.[3] ..... B22D 17/20

[52] U.S. Cl. ..... 164/305; 164/410; 425/420; 425/812

[58] Field of Search ..... 164/253, 305, 410; 425/420, 812

[56] References Cited

U.S. PATENT DOCUMENTS

| | | | |
|---|---|---|---|
| 2,785,448 | 3/1957 | Hodler | 164/305 |
| 2,867,869 | 1/1959 | Hodler | 164/305 X |
| 2,971,230 | 2/1961 | Coleman et al. | 164/305 |
| 3,349,833 | 10/1967 | Hodler | 164/305 X |
| 3,433,291 | 3/1969 | Hodler | 164/305 |
| 3,885,618 | 5/1975 | Hodler | 164/305 X |
| 3,892,508 | 7/1975 | Hodler | 164/305 X |
| 4,027,726 | 6/1977 | Hodler | 164/305 |
| 4,239,080 | 12/1980 | Hodler | 164/305 |

*Primary Examiner*—Nicholas P. Godici
*Assistant Examiner*—J. Reed Batten, Jr.
*Attorney, Agent, or Firm*—Finnegan, Henderson, Farabow, Garrett, & Dunner

[57] ABSTRACT

A gas-venting valve includes a sliding valve and either a fixed or movable valve chamber. The valve is closed by impingement of molten metal or melt flowing out of a cavity defined by the mold, in such a manner that the valve is forced to move relative to the valve chamber from a first position to a second position. The invention further includes a device for urging the valve to move relative to the valve chamber from the first position to the second position; a device for restraining the valve at the first position and preventing it from moving toward the second position, against the force of the urging device, until a part of the melt impinges against the valve; and a device for actuating the valve to return from the second position to the first position against the force of the urging device.

24 Claims, 36 Drawing Figures

GAS-VENTING ARRANGEMENT INCORPORATED WITH A MOLD

BACKGROUND OF THE INVENTION

The present invention relates to a gas-venting arrangement incorporated with a mold for use in a molding machine, such as a die casting machine or an injection molding machine, particularly to an improvement of the gas-venting arrangment of the type disclosed in Australian Pat. No. 516,938 and U.S. Pat. No. 4,431,047 to Takeshima et al., which issued Feb. 14, 1984.

The gas-venting arrangment incorporated with a mold, disclosed in U.S. Pat. No. 4,431,047, is illustrated in FIGS. 1 and 2 of this application. Referring to these figures, reference numerals 1 and 2 represent stationary and movable platens, respectively. A mold is shown consisting a stationary mold half 3 and a movable mold half 4. A cavity 7 to be filled with a melt is defined by the mold halves 3 and 4. The mold is provided with a push plate or ejector 5 and push pins 6. A molten metal casting hole 8 is formed in the mold to communicate with the cavity 7. A shallow but wide groove is formed in the movable mold half 4 in an area on the periphery of the cavity 7. The shallow groove and a flat parting face of the stationary mold half 3 facing the groove define a thin gas vent passage 9 in the mold. An additional gas vent passage 10 connected to the top end of the thin gas vent passage 9 and extending upwardly or rearwardly is formed in the mold. The additional gas vent passage 10 lies on the parting faces of the two mold halves 3 and 4. In other words, it has a cross-section taken along a line parallel to the axis of the mold, the shape of the cross-section being defined by the two mold halves 3 and 4. At the opposite end of the gas vent passage 10 from gas vent passage 9 are a valve chamber 11 that can be split into two parts, a valve seat 12 and a gas discharge passage 13 having an outlet 20 opening to the outside of the mold which are formed in the mold, so that they are arranged upwardly in series on the parting faces of the two mold halves 3 and 4. A slide valve 14 capable of sliding in the vertical direction is disposed in the valve chamber 11. The valve 14 has a disc-shape, and the periphery of the upper end of the valve 14 is tapered.

Two symmetrical by-pass passages 15 detouring around the valve 14 are formed to extend from the gas vent passage 10 a portion of the valve chamber 11 to close to the valve seat 12. An intersecting angle $\theta$ formed by the gas vent passage 10 and the inlet portion of each by-pass passage 15 is an acute angle or a right angle. That is, the angle $\theta$ between the gas vent passage 10 and each of the by-pass passages 15 at a point where each of the by-pass passages 15 is branched from the gas vent passage 10 is not more than 90°. A mouth portion 16 of the gas vent passage 10 facing the valve chamber 11 is narrowed like a nozzle.

A coil spring 17 is disposed in the gas discharge passage 13 and a hydraulic cylinder 18 for actuating a piston rod 19 connected to the spring 17 is secured to the top of the stationary mold half 3. The valve 14 is urged against the lower end or forward end of the valve chamber 11 by the spring 17. When mold clamping is carried out in the state where the slide valve 14 is located in the valve chamber 11, as illustrated in FIGS. 1 and 2, the valve 14 is pressed downwardly or forwardly by the actions of the cylinder 18 and the coil spring 17 so that it abuts against the forward end of the valve chamber 11, and each of the by-pass passages 15 communicates with the upper or rear portion of the valve chamber 11. In this state, the gas discharge passage 13 communicates with the by-pass passages 15 through the valve chamber 11.

In the above state, when a molten metal or melt is injected into the cavity 7 from the casting hole 8, the gases in the cavity 7 are passed through the gas vent passage 9, the additional gas vent passage 10, the by-pass passages 15, the upper portion of the valve chamber 11 and the gas discharge passage 13, and are discharged from the outlet 20. During the period while a melt 21 is being charged into the cavity 7, as illustrated in FIG. 3A, the slide valve 14 is maintained pressed to the lower portion of the valve chamber 11, and a large quantity of the gases is vented through the by-pass passages 15 as indicated by arrows in FIG. 3A.

When injection of the melt 21 into the cavity 7 is substantially completed, a part of the melt 21 rises in the gas vent passage 10 and impinges against the lower part of forward face of the valve 14, with the result that the valve 14 is pushed up against the downward force of the coil spring 17 by the melt 21, and another part of the melt 21 starts intruding into the by-pass passages 15. The state at this point is illustrated in FIG. 3B.

The slide valve 14 closes the by-pass passages 15 when the melt 21 pushes upward and the flow of the melt 21 is stopped. At this point, the gases which have passed through the by-pass passages 15 are substantially vented and only a slight amount of the gases is left in the vicinity of the valve seat 12. These residual gases have no bad influences on the cast product in cavity 7. The state at this point is illustrated in FIG. 3C.

When the casting or injection operation is completed, the cylinder 18 is operated to lift up the coil spring 17 away from slide valve 14 against the mold, and then the mold opening operation is carried out. The state at this point is illustrated in FIG. 3D. Subsequently, the cast product is removed from the mold by the operation of the push pin 6, and simultaneously, the gas vent passage 10, the lower or forward portion of the valve chamber 11, a solidified metal 21*a* in the gas vent passage 10, the lower or forward portion of the valve chamber 11, and the by-pass passages 15 as well as the valve 14 are removed together.

The above arrangement utilizes the difference in the specific gravities of the gases and the molten metal (for example, the ratio of the specific gravity of air to molten aluminum is about 1/2000), and, also, the disparity of the force of inertia arising in each material owing to this difference in said specific gravities.

In order to prevent the molten metal 21 rising in the gas vent passage 10 from intruding directly into the by-pass passages 15, and also, to prevent the melt 21 from passing between the valve 14 and the valve seat 12 before the valve 14 is moved rearwardly, the angle $\theta$ formed by the gas vent passage 10 and the inlet portion of each of the by-pass passages 15 is adjusted to be an acute angle or a right angle. Preferably, the angle $\theta$ is an acute angle.

At the start of each casting, the slide valve 14 is set in a split half of the valve chamber 11 in the stationary mold half 3, and after the slide valve 14 is pressed downwardly in the lower portion of the valve chamber 11 by the spring 17, the mold is closed. When the slide valve 14 is formed of a material different from the molten metal 21, after withdrawal of the cast product, the slide valve 14 is separated from the cast product and the portion of the solidified metal 21*a* present in the vicinity thereof, after which it may be reused. When the valve 14 is formed of the same material as the molten metal 21, the used valve 14 is either thrown away or it may be fused together with portion of the solidified metal 21*a* present in the vicinity of the cast product, such as a sprue and flashes or fins in order to produce a molten metal for casting. When the die casting operation is carried out by using the gas-venting arrangement, a slide valve 14 of the same material as the molten metal 21 can be prepared by said die casting operation using a part of the mold of the die casting machine.

According to the above disclosed art, the following advantages can be obtained.

1. Since the gas discharge passage is shut by the valve which is directly pressed by a molten metal injected into the mold, said metal having advanced directly into the gas vent passage, the valve is thereby moved in the same direction as the advancing direction of the molten metal, the closing of the valve chamber is performed quickly, thus gas venting and prevention of the molten metal from intruding into the valve chamber can be accomplished.

2. Since the gases are sufficiently vented at the injection step, the amount of the gases left in an injection molded product can be drastically reduced, and the running characteristic of the melt, and the pressure resistance and air tightness of the injection-molded product can be remarkably improved.

3. Since formation of fins is reduced in the air vent portion around the cavity, removal of fins need not be carried out and the mold is not damaged, with result that automation of the molding operation can be facilitated and the life of the mold can be prolonged.

4. Since gas venting is sufficiently accomplished, an injection-molded product of a good quality can be obtained under a low injection pressure. Of course, by virtue of this feature, automation of the operation can be facilitated and the life of the mold can be prolonged.

5. Since gas venting is sufficiently accomplished, the allowable ranges of injection conditions can be broadened, and the effects of shortening the time of a trial injection and stabilizing the quality in injection-molded products can be attained. According to the conventional technique, the injection pressure, injection speed and high speed injection-starting position suitable for the gas-venting operation must be determined prior to each series of casting operations. However, a long time is required for determining these variables, which are then gradually changed during the operation. In contrast, according to the disclosed art, since gas venting is sufficiently accomplished, the allowable ranges of injection conditions can be broadened remarkably.

6. There has previously been proposed a method in which air is vented from the cavity through a shallow groove formed on the parting face of the mold half by means of a vacuum device. In this method, however, if the amount of air vented from the cavity is small, air is in turn, introduced from the outside of the mold through gaps in the parting faces of the mold, and a vacuum condition is not produced in the cavity. In contrast, according to the disclosed art, since a large quantity of air is vented, the precision of mating or fitting the parting face of the movable mold half with that of the stationary mold half is not a severe problem. Therefore, if a pressure reduction method is adopted in performing the disclosed art, the effect can be further enhanced.

7. If a nonporous die casting method, where injection is conducted in the cavity with an atmosphere of an active gas, such as oxygen, is adopted in using the disclosed, products of a very high quality can be obtained. In this case, prior to injection of the molten metal, an active gas is introduced into the cavity, from the gas discharge outlet of the gas-venting arrangement, and then injection is performed. Alternatively, active gas can be introduced into the cavity also during injection.

8. Remarkable advantages can be obtained when the disclosed art is applied to die casting of magnesium. In die casting of aluminum there can be adopted a method in which injection is slowly performed to vent the gas from the cavity to the vent portion. However, in the casting of a magnesium alloy, since the solidification speed of the magnesium alloy is very high, low-speed injection is not possible. Instead, soon after the start of the injection operation, the injection speed should be increased to a high level. In the injection operation, a large quantity of the gas contained in the cavity and injection sleeve, which has a volume about 2 times the volume of the cavity, should be vented to the outside of the mold. In die casting of magnesium, since the injection speed should be maintained at a level higher than in die casting of aluminum, inclusion of a relatively large quantity of the gas in an injection-molded product could not be avoided under the prior art. However, when the disclosed art is adopted, since gas venting is sufficiently performed, even in the case of die casting of magnesium, an injection-molded product free of voids can be obtained easily and assuredly.

9. The disclosed art can also be applied to hot chamber-type die casting.

10. According to the conventional technique, after the mold is opened, cooling water or a water-soluble parting agent is sprayed onto the surface of the cavity. When drops of water are left in the mold at the time of mold clamping steam cannot escape, and if an injection is performed in this state, the surface of an injection-molded product is blackened or running of the melt becomes poor, with the result that it becomes impossible to obtain an injection-molded product of high quality. Therefore, mold clamping should be performed after drops of water on the surface of the cavity have been evaporated off by sufficient drying. However, according to the disclosed art, if hot air is fed into the mold through the gas discharge outlet of the gas venting arrangment at the time of mold clamping, steam in the mold is allowed to escape through the injection sleeve. That is, the steam is forced out of the mold by the hot air introduced from the opening end of the gas discharge passage. This feeding of hot air can be conducted not only at the time of mold clamping, but also at the time of the supply of a melt. Accordingly, if an arrangement is made so that hot air is fed into the cavity through the gas-venting arrangement, mold clamping can be accomplished immediately after spraying of the parting agent, and therefore, the operation cycle can be shortened.

11. The gas-venting arrangement can also be used as a permanent means.

The disclosed art provides significant advantages. However, the present invention has discovered that, when the melt part, which is to impinge against the valve 14, flows discontinuously through the gas vent passages 9 and 10, the closing of the valve chamber 11 does not always perform completely and assuredly. This happens when a leading portion of the discontinuous melt part impinges initially against the valve 14, the valve may be forced to move upwardly against the downward force of the coil spring 17 from an open position to a second position, closing the valve chamber 11. Valve 14 may be forced by the downward force of the coil spring 17 to return to the first position to open the valve chamber 11 during a period of time between initial impingement of the leading portion of the melt part until the following portion of the melt part reaches the leading portion at the valve 14.

Under these circumstances, the gas-venting arrangement may encounter the following serious problems. The subsequent or following portion of the melt part approaches valve 14, while the leading portion is in the process of solidification at the front face of the valve 14 and adhering to the valve face as well as to the inner walls of the mouth portion 16 in the vicinity of the valve 14. This will cause the impinging force of the following melt portion to be considerably reduced. This is because the following melt portion impinges pinges against the valve 14, via the leading melt portion which has adhered to the walls and to the valve. Thus, the following melt does not impinge directly against the valve but the leading melt portion. This means that the following melt portion is subjected to a resistance or friction of the leading melt portion generated in the impinging process. This will prevent valve 14 from returning smoothly to the second position, and will result in the valve chamber 11 being not closed completely or the valve 14 not arriving completely at the second position at the final stage of the discontinuous impingement. Further, this will cause axial oscillation of the valve to occur in the process of the discontinuous impingement.

The above mentioned phenomenon will cause the melt to have the opportunity to intrude into the valve chamber 11 through the by-pass passages 15 and through the space gap produced due to the incompleteness of the closing between the valve seat 12 and the valve 14. In such a case, the arrangement neither functions as expected nor attains the expected advantages. Further, there may arise problems that are troublesome, namely, to remove the melt solidified at the valve and at the valve chamber. Thus continued discontinuous impingments will cause the mold machine to be prevented from repeating the injection molding operation smoothly.

SUMMARY OF THE INVENTION

It is an object of the present invention to solve the above mentioned problems and, therefore, to provide an improved gas-venting arrangement incorporated with a mold of the melt impinging type, wherein the complete closing of the valve chamber is performed very smoothly, quickly and assuredly, and gas venting and prevention of the molten metal or melt from intruding into the valve chamber can be accomplished assuredly and conveniently even during the occurrence of discontinuous impingement of the melt against the valve.

According to the present invention, there is provided a gas-venting arrangement incorporated with a mold for use in a die casting machine or an injection mold machine. The mold consists of stationary and movable mold halves, both defining a cavity to be filled with a molten metal or melt. The gas-venting arrangement comprises: a gas vent passage formed in the mold to communicate with the cavity; at least one by-pass passage branched from the gas vent passage, formed in the mold; a gas discharge passage formed in the mold to communicate with the outside of the mold; and valve means, including a movable valve confronting the gas vent passage and a valve chamber having a valve seat formed in the mold, for opening and closing the gas vent passage, the by-pass passage and the gas discharge passage in such a manner that the valve cooperates with the valve chamber, to prevent the gas vent passage from communicating with the gas discharge passage, while allowing the by-pass passage to communicate with the gas discharge passage, when the valve is in a first position relative to the valve chamber, and, to prevent the by-pass passage and the gas vent passage from communicating with the gas discharge passage when the valve is in a second position relative to the valve chamber. The by-pass passage may be designed so as to detour from the gas vent passage to the valve chamber. Alternatively, the by-pass passage may be designed so that an enlarged portion of the gas vent passage in the vicinity of the valve chamber and the valve lodged in the enlarged portion, in combination, define the by-pass passage.

In the above arrangement, the valve is forced to move from the first position to the second position by a part of the melt forced to flow out of the cavity and through the gas vent passage upon impingement of the melt part against the valve, before a part of the melt part flowing through the by-pass passage reaches the valve chamber. The cavity, the gas vent passage, the by-pass passage and at least a forward portion of the valve chamber communicating with the gas vent passage have cross-sections which are parallel to the axis of the mold, the shape of each cross-section being defined by both mold halves.

The valve means may be located so that it has an axis perpendicular to the axis of the mold. Alternatively, it has an axis parallel to the axis of the mold. In both cases, preferably the gas vent passage and the by-pass passage may lie on a plane perpendicular to the axis of the mold.

With respect to the movement of the movable valve, the valve may be mounted in the mold and in the valve chamber for an axial movement and the valve means may be designed so that the valve slidably moves from the first position to the second position along the axis of the valve chamber. Alternatively, the valve may be pivoted so as to rotate about the pivotal axis and the valve means may be designed so that the valve is rotated from the first position to the second position.

A gas evacuation means such as a suction cylinder or vacuum tank is preferably provided in such an arrangement that an inlet of the evacuation means communicates with the outlet of the gas discharge passage. The operation of the evacuation means may be synchronized with the operation of the injection operation.

According to the present invention, the above-mentioned arrangement further comprises means for maintaining the valve at the second position, after the valve is forced to move from the first position to the second position by an initial impingement of the melt part.

Preferably, the maintaining means includes means for urging the valve to move from the first position toward the second position, and the arrangement further comprises means for restraining the valve at the first position and preventing the valve from moving toward the second position, against the force of the urging means, until the melt part impinges against the valve. The arrangement may further comprise means for actuating the valve to return from the second position to the first position against the force of the urging means.

The actuating means may comprise the melt part which has impinged against the valve and been solidified at the valve during the casting operation.

BRIEF DESCRIPTION OF THE DRAWINGS

The gas-venting arrangement of the present invention can be more fully understood from the following detailed description with reference to the accompanying drawings in which.

DESCRIPTION OF THE PREFERRED EMBODIMENTS

Figure 1:
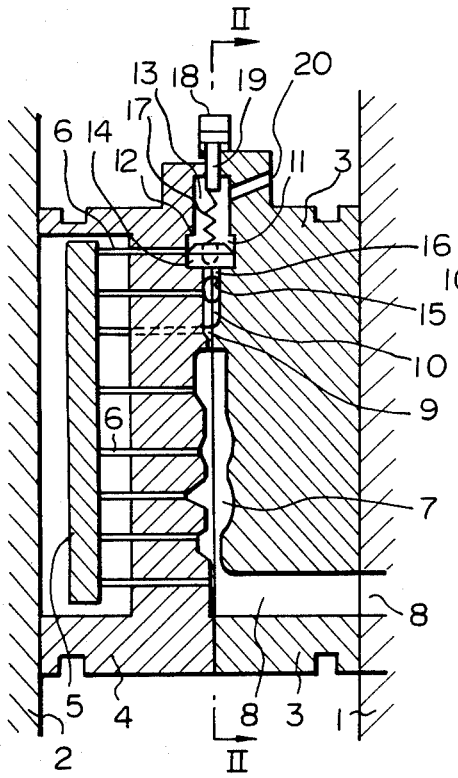
Fig. 1 (PRIOR ART)
FIG. 1 is a longitudinally sectional view illustrating an example of a conventional gas-venting arrangement incorporated with a mold.
Figure 2:
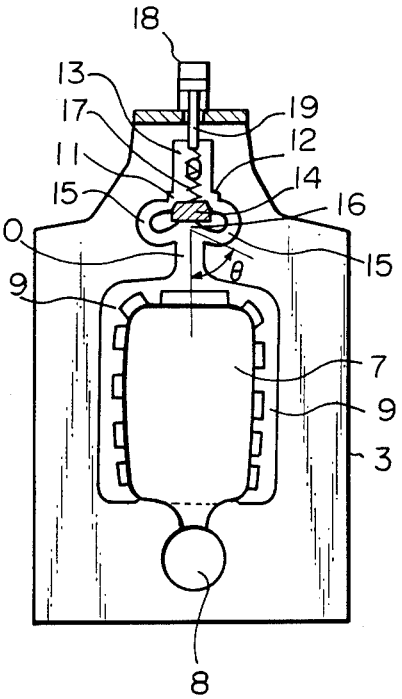
Fig. 2 (PRIOR ART)
FIG. 2 is a view taken along the line II—II in FIG. 1.

To begin with, the same numerals in the figures represent the same or similar members or elements.

The first type of the gas-venting arrangement illustrated in FIG. 4, FIGS. 5A, 5B and 5C and FIG. 6A, has valve means having an axis perpendicular to the horizontal axis of the mold. Referring to these figures, a valve 14 of a disc shape has a vertical axis and is mounted for a vertical movement relative to the mold, which consists of a stationary mold half 3 and a movable mold half 4 and all have a common horizontal axis. The valve 14 has an upward axial extension 140 having horizontally extending arms 141 and 142. A valve chamber 11 is an upward hollow extension mounted for a vertical movement relative to the mold. The valve extension 140 is vertically slidable into the valve chamber 11 through a valve guide 110 disposed therein and fixed thereto. A numeral 20 denotes an outlet opening to the outside of the mold corresponding to the outlet 20 in FIG. 1. The urging means comprises a vertically extending coil spring 40 connected to the top free end of the valve extension 140 and the top end of the valve chamber 11. The coil spring 40 is designed so that it pulls the valve 14 upwardly.

The restraining means comprises a top portion 14*a* of the valve extension 140 constricted, in a vertically cross sectional view, forming opposite recesses 143 and 144, and opposite resilient plates 51 and 52 extending horizontally across the inner space of the valve chamber 11 and disposed in the valve chamber 11 in such arrangement that the valve extension 140 is sandwiched by the opposite resilient plates 51 and 52, so that the resilient plates urge themselves against the surface of the valve extension 140 including opposite local surfaces of the constricted portion 14*a*. The actuating means comprises a hydraulic or pneumatic cylinder 18 mounted onto the stationary mold half 3 by means of a base 30 which opens to outside of the mold or to the atmosphere. The cylinder 18 is provided with a piston 19 which is actuated in a vertical direction. The piston 19 passes through a hole 33 formed on the top end of the base 30 and is connected to the valve chamber 11 at the top thereof.

The actuating means further comprises the melt part 21 which has impinged against the valve 14 and been solidified at the valve during the casting operation.

The resilient plates 51 and 52 are moved downwardly relative to the valve extension 140 from the constricted portion 14*a*, that is, from the recesses 143 and 144 to the local enlarged portion 14*b* of the valve extension 140 following the lower end of the constricted portion 14*a*, when the valve is forced to move from the first position to the second position. The resilient plates 51 and 52 are moved upwardly relative to the valve extension 140 and engaged with the constricted portion 14*a*, when the piston 19 is actuated to move upwardly relative to the mold, due to the resistance of the melt part 21 solidified at the valve 14 against the resilient force of the coil spring 40 as shown in FIG. 5C.

The actuating means further comprises opposite stoppers 31 and 32 provided in the base 30 for stopping the upward movement of the valve relative to the mold. The valve chamber 11 has vertically extending slots 111 and 112 formed in opposite side walls, while the valve extension 140 has opposite arms 141 and 142 horizontally extending outwardly through the slots 111 and 112. The arms 141 and 142 are vertically slidable into and guided by the slots. The arms 141 and 142 and the stoppers 31 and 32 in combination are designed so that the stoppers abut against the arms to prevent the valve 14 from moving upwardly relative to the mold, while the piston 19 is moving upwardly relative to the mold, whereby the valve 14 is forced to return from the second position to the first position even without the melt part 21 being solidified at the valve 14.

The stoppers 31 and 32 comprise adjusting bolts 31*a* and 32*b* by which the abutting position of the arms 141 and 142 relative to the valve chamber 11 is optionally determined.

Figure 5A:
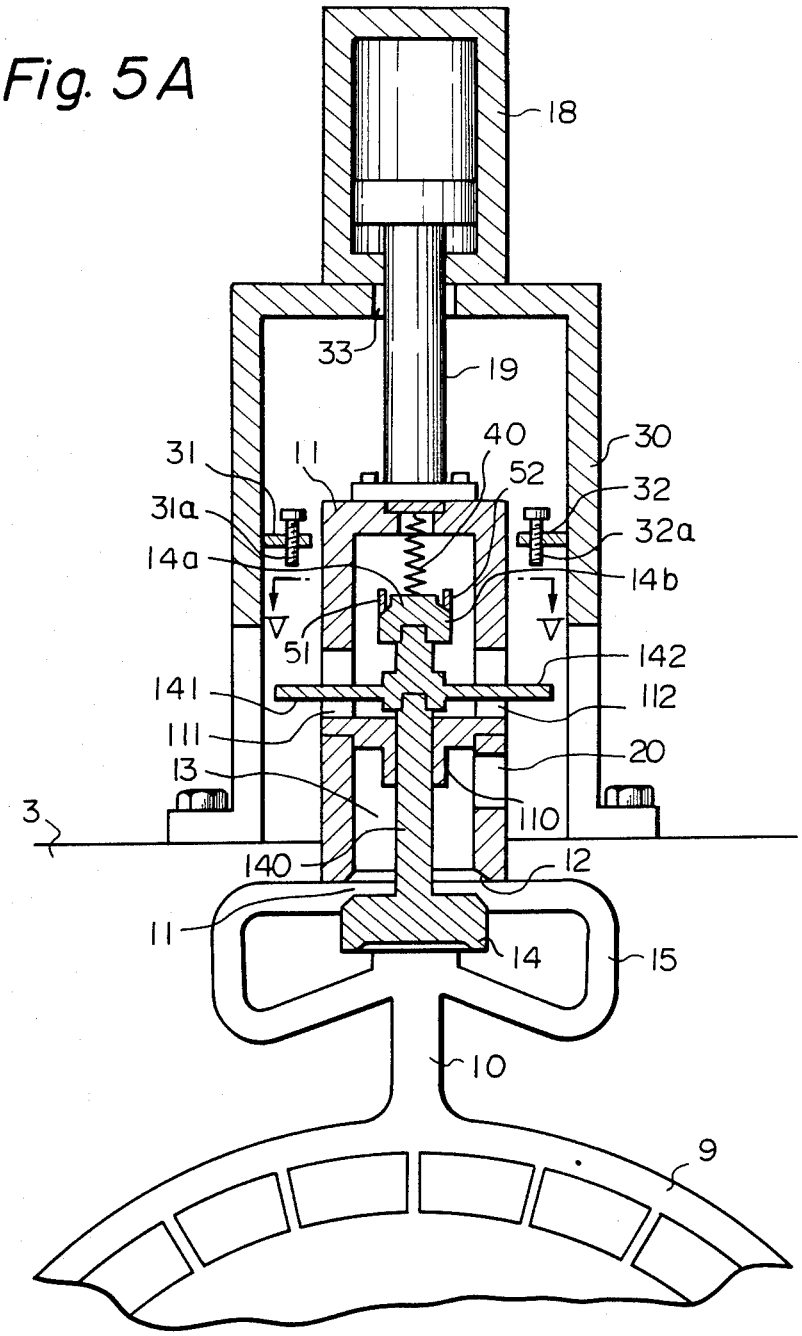
FIGS. 5A, 5B and 5C are enlarged sectional views illustrating the main portion of the gas-venting arrangement of FIG. 4, and show three stages of the operations of the gas-venting arrangement.

FIG. 5A shows the gas venting arrangement which is in a starting position and is ready to be subjected to injection molding. In this position, the valve 14 is in the first position relative to the valve chamber 11 and the valve chamber 11 abuts against the mold. The resilient plates 51 and 52 are engaged with the constricted portion 14*a* or the recesses 143 and 144.

Figure 5B:
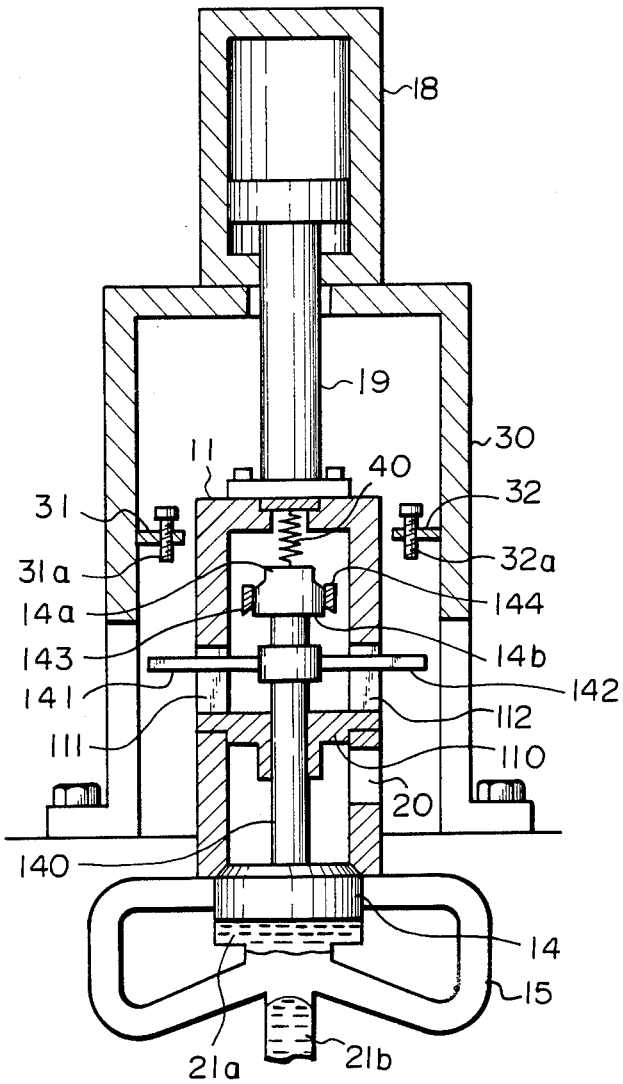
Figure 5C:
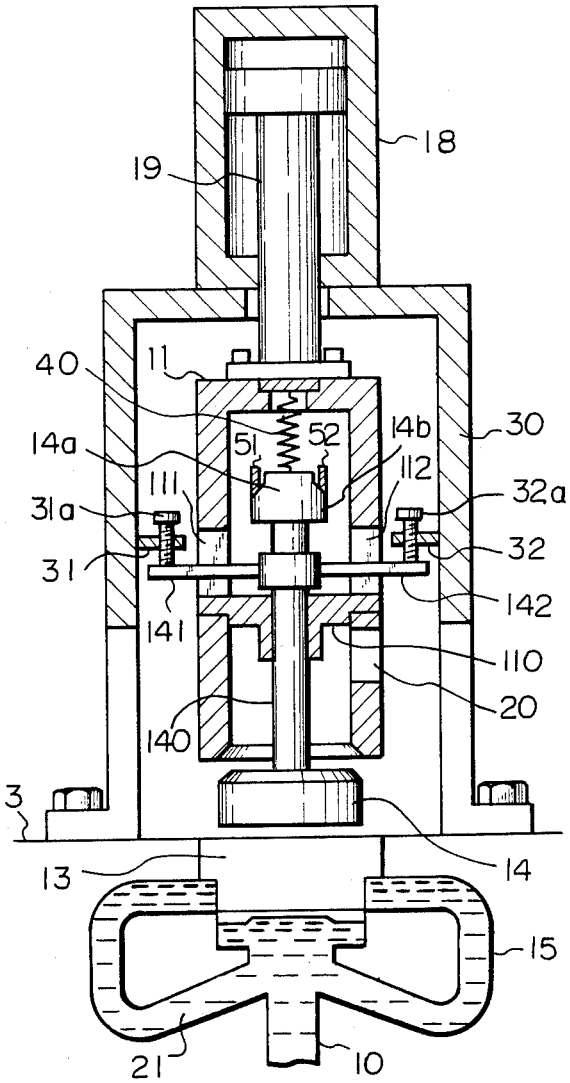

FIG. 5B shows the gas-venting arrangement which is in an impinged position where a leading portion 21A of the melt part has impinged against the valve 14. That is, in this position, the valve 14 is in the second position relative to the valve chamber 11 while the valve chamber 11 abuts against the mold. The resilient plates 51 and 52 are released from engagement with the recesses 143 and 144.

FIG. 5C shows the gas venting arrangement which is in the final position where the molded product is allowed to be removed from the mold.

In this position, the valve 14 is in the second position relative to the valve chamber 11 and the valve chamber 11 is in an upper limit position where the valve chamber 11 is apart upwardly from the mold and the valve 14 is apart from the mold and the melt part 21 and the arms 141 and 142 abuts against the stoppers 31 and 32. The resilient plates 51 and 52 are released from the engagement with the recesses 143 and 144.

In the above arrangement in the starting position as shown in FIG. 5A, the injection operation can be carried out. In this state, when the melt is flown into the cavity 7 from the casting hole 8, the gases in the cavity 7 are passed through the gas vent passage 9, the additional gas vent passage 10, the by-pass passages 15 and the valve chamber 11, and then are discharged out of the outlet 20. During the period in which the melt 21 is being charged into the cavity 7, the valve 14 is maintained in the first position as shown in FIG. 5A, and a large quantity of the gases is vented from the mold through the by-pass passages 15 and the outlet 20. When the injection is almost completed, a part of the melt rises in the gas vent passage 10 and continuously or discontinuously impinges against the front face of the valve 14.

Even if the melt part 21 flows discontinuously, the valve 14 is pushed up against the force of the resilient plates 51 and 52 by an initial impingement of the melt (a leading portion 21A) against the valve, as shown in FIG. 5B. In this case, the resilient plates are released from engagement with the constricted portion 14*a* of the valve extension 140, that is, they are bent as illustrated by phantom lines in FIG. 6A and moved downwardly, relative to the valve extension 140, to the local enlarged portion 14*b* of the valve extension 140 following the recesses 143 and 144, and the resilient plates 51 and 52 are moved downwardly along the local surfaces by the upward force of the coil spring 40, until the valve 14 arrives at the second position. After the valve 14 has arrived at the second position, it is retained there by the upward force of the coil spring 40.

Therefore, during the interval of time after the leading portion 21*a* of the melt part impinges against the valve 14 before the following portion 21*b* of the melt part reaches the leading portion 21*a* which has impinged and is going to adhere to the valve 14, the valve remains in the closed second position. Thus, the valve chamber 11 remains closed by the valve 14 due to the upward force of the coil spring 40. This means that no oscillation of the valve 14 occurs even in the case of discontinuous impingement or dicountinuous flow of the melt part.

In marked contrast, it is noted that the arrangement illustrated in FIG. 1 has the valve 14 which is subjected to a downward force of the coil spring 17, and thus the valve 14 is pushed upwardly against the downward force of the coil spring 17 by the impingement of the melt part 21. Therefore, in this case the above-mentioned interval of time and the downward force of the coil spring 17 would cause the valve to return to the first position, and thus the discontinuous impingement or discontinuous flow of the melt part causes occurrence of undesirable oscillation of the valve between the first position and the second position.

After the injection is completed, the movable mold half 4 is moved so that the molded product can be removed from the mold. The hydraulic cylinder 18 is actuated so that the piston 19 is moved upwardly, before or simultaneously with the movement of the movable mold half 4. When the hydraulic cylinder 18 is actuated as above, the valve chamber 11 is moved upwardly with the piston 19 at the same speed, but the upward movement of the valve 14 is delayed as compared with the valve chamber 11. The delayed movement of the valve 14 is caused by the resistance of the melt part 21 which has adhered to the inner wall of the mouth portion 16 of the gas vent passage 10, solidifying at the valve against the upward force of the coil spring 40.

As a result, while the piston 19 is moving upwardly and simultaneously the valve chamber 11 is being removed from the mold, the resilient plates 51 and 52 are moved upwardly relative to the valve extension 140 and become engaged with the recesses 143 and 144, that is, the valve 14 is moved downwardly from the second position to the first position relative to the valve chamber 11. After the valve 14 returns to the first position, the valve is not allowed to move downwardly further relative to the valve chamber 11, since the coil spring 40 and the valve including the valve extension 140 and the other elements such as the arms 141 and 142 are designed so that the upward force of the coil spring 40 overcomes the weight of the valve as a whole.

Thus, the valve 14 is forced to remain at the first position relative to the valve chamber 11, until the arms 141 and 142 of the valve 14 reach the stoppers 31 and 32. If the piston 19 is allowed to move upwardly further after the stoppers abut against the arms, the valve 14 would commence to move downwardly relative to the valve chamber 11 by the force of the piston 19 against the force of the coil spring 40 causing the valve 14 to be apart from the valve chamber 11 over the predetermined gap between the valve and valve chamber at the first position. However when the hydraulic cylinder 18 is actuated so that the piston 19 is moved downwardly, the valve 14 is returned to and maintained at the first position, and the valve chamber 11 is returned to the position where it abuts against the mold. Such piston actuation must be made after the operation of removing the molded product and solidified melt is completed. When the valve chamber 11 is returned so that it abuts against the mold, the arrangement is in a position to be subjected to a further injection of the melt.

Figure 3A:
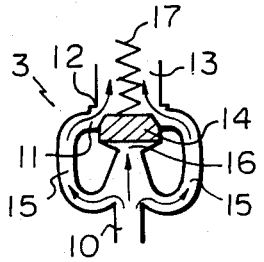
Fig. 3A (PRIOR ART)
FIGS. 3A, 3B, 3C and 3D are diagrams illustrating operations of a slide valve portion illustrated in FIG. 2 during the injection operation.
Figure 3B:
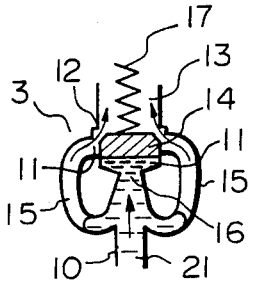
Fig. 3B (PRIOR ART)
Figure 3C:
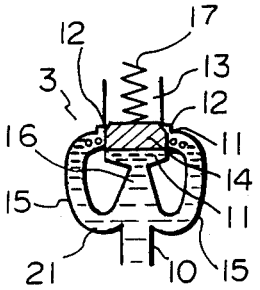
Fig. 3C (PRIOR ART)
Figure 3D:
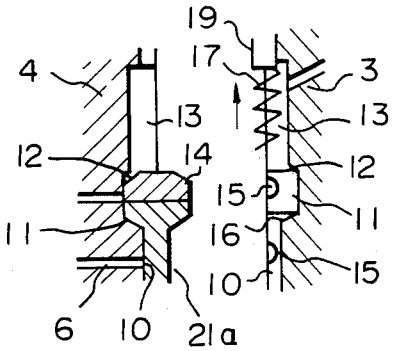
Fig. 3D (PRIOR ART)
Figure 4:
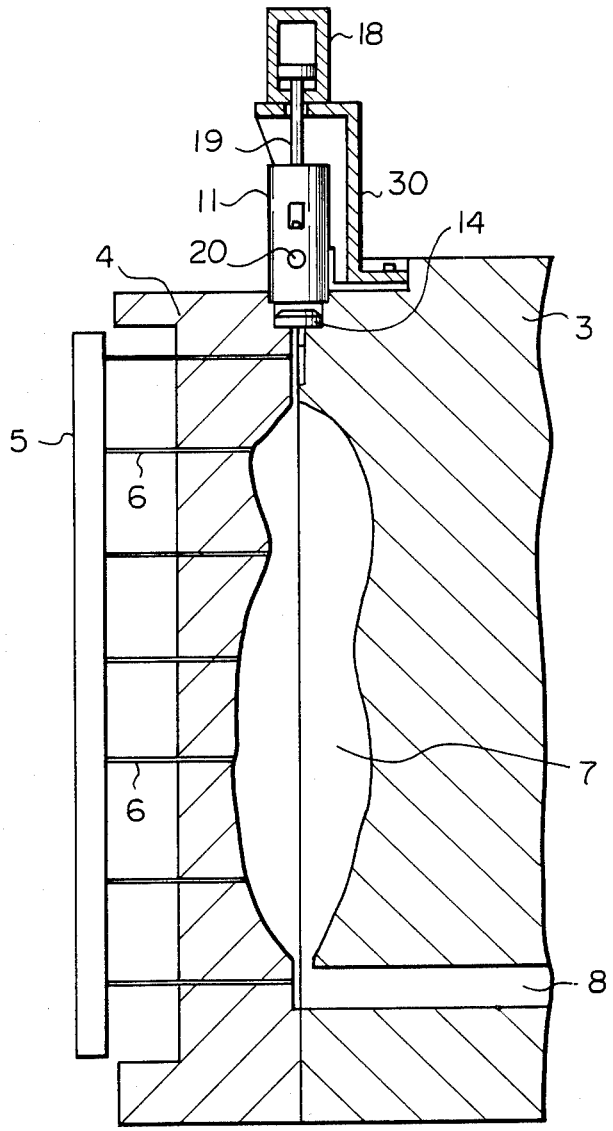
FIG. 4 is a longitudinally sectional view corresponding to FIG. 1 and illustrating a first type of the gas-venting arrangement incorporated with a mold of a first type according to the present invention.

The stopper means, involving the stoppers 31 and 32 and the arms 141 and 142 of the valve extension 140, is provided in order to make the valve 14 return from the second position to the first position without any assistance of the melt part 21 adhered and solidified at the valve. This is intended to be used just before an initial injection operation is carried out. This is also intended to cope with a lost injection or an injection without any melt. The resistance of the melt part against the upward force of the coil spring 40 is created by a portion of the melt adhered to the front face of the valve 14 and other portions of the melt adhered to the side faces of the valve exposed to the by-pass passages 15. The other portions, in most cases, include voids of the gases as shown in FIG. 3C. However, the resistance of the melt can be enhanced by so designing that the exposed side surfaces of the valve have recesses or notches.

Figure 6A:
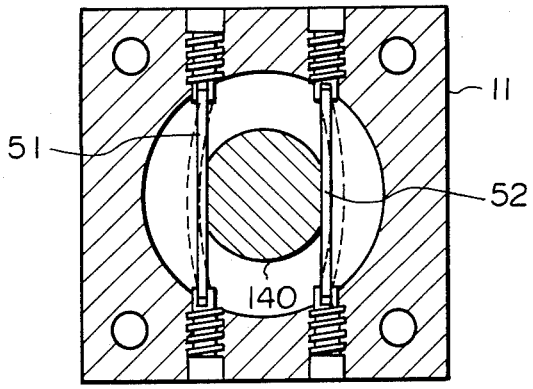
FIG. 6A is a view taken along the line V—V in FIG. 5A.
Figure 6B:
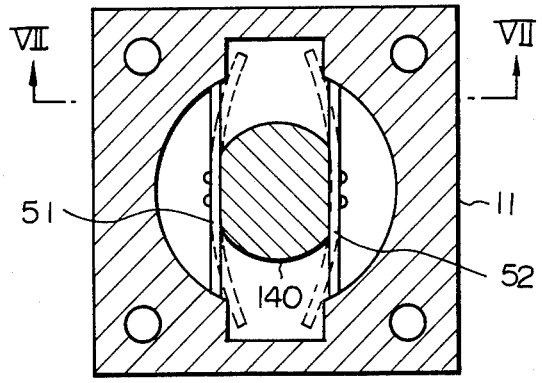
FIG. 6B is a view corresponding to FIG. 6A and illustrating a modification of the first typed arrangement shown in FIG. 6A.
Figure 7:
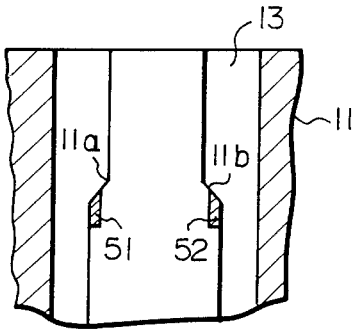
FIG. 7 is a partial view taken along the line VII—VII in FIG. 6B.

Referring to FIG. 6A, the arrangement shown in FIG. 5A has the resilient plates 51 and 52 which are secured to the opposite inner walls of the valve chamber 11. FIG. 6B and FIG. 7 show a modification of the arrangement, wherein resilient plates 51 and 52, corresponding to those in FIG. 6A, are secured to a valve extension 140 at the opposite side walls thereof. The valve extension 140 is not required to have such a constricted portion as that of 14*a* in the arrangement shown in FIG. 5A and, in turn, a valve chamber 11 may have a configuration as shown in FIGS. 6B and 7.

When the valve 14 is in the first position, the resilient plates 51 and 52 are engaged with opposite shoulders 11*a* and 11*b*. When the valve 14 is moved upwardly relative to the valve chamber 11, the resilient plates 51 and 52 are forced to move upwardly relative to the valve chamber 11 and are released from the engagement with the shoulders 11*a* and 11*b*.

In the above embodiments, a hydraulic or solenoid cylinder may be used as the maintaining means in place of the coil spring 40. In this case, a stopping means including the stoppers 31 and 32 and the arms 141 and 142 is not necessary.

Further, a weight device having a weight connected to the valve extension 14 by a rope through a pulley may be employed as the maintaining means in place of the coil spring 40.

The coiled spring 40 is used as a draft spring in the embodiments, so that it urges the valve 14 upwardly against the valve chamber 11. However, a compression spring may be used in place of the above-mentioned spring. In this case, the compression spring must be disposed between the guide 110 and the enlarged portion 14*b* so that it urges the valve extension 14 upwardly against the valve chamber 11.

Figure 8:
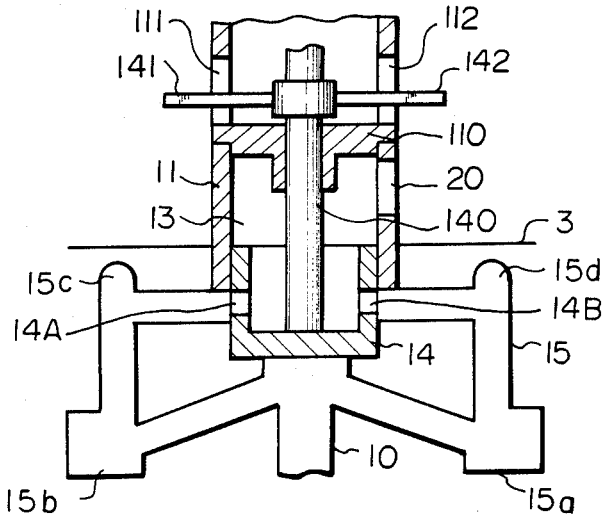
FIG. 8 is a partial longitudinal sectional view illustrating another modification of the first typed arrangement shown in FIG. 5*a;*

FIG. 8 shows a modification of the arrangement shown in FIG. 5A, wherein a valve 14, corresponding to the valve shown in FIG. 5A, is cylindrical, and by-pass passages 15 have additional spaces 15*a*, 15*b*, 15*c* and 15*d* where the melt can be received. The cylindrical valve 14 has oppositely positioned gas inlets 14A and 14B. The gas inlets 14A and 14B are designed, so that they communicate with the corresponding gas vent passages 15, when the valve 14 is in the first position as shown in FIG. 8 and are closed when the valve is in the second position.

Figure 9:
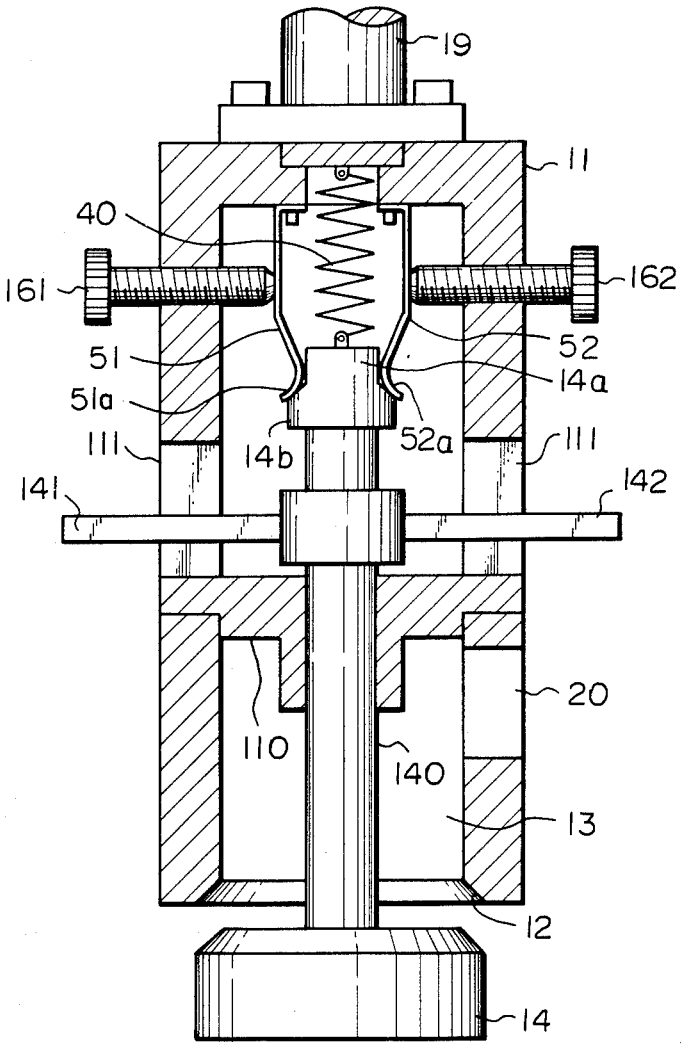
FIG. 9 is an enlarged sectional view corresponding to FIG. 5B and illustrating a second embodiment of the first typed arrangement according to the present invention.

FIG. 9 shows a modification of the arrangement shown in FIG. 5A, wherein resilient plates 51 and 52 are vertical extensions. The top ends of the resilient plates are fixed to the top end of the chamber 11, while the lower free ends 51*a* and 52*a* of the resilient plates are curved so that a local zone of the valve extension 14 defined by the constricted portion 14*a* is receptive of the curved ends 51*a* and 52*a*.

The valve chamber 11 is provided with opposite bolts 161 and 162. These bolts are disposed through the opposite side walls of the valve chamber 11 so that they abut against the outer surfaces of the vertical resilient plates 51 and 52 and urge the resilient plates against the valve extension 14, respectively. Therefore, the forces of the resilient plates 51 and 52 can be adjusted by driving the bolts.

Figure 10:
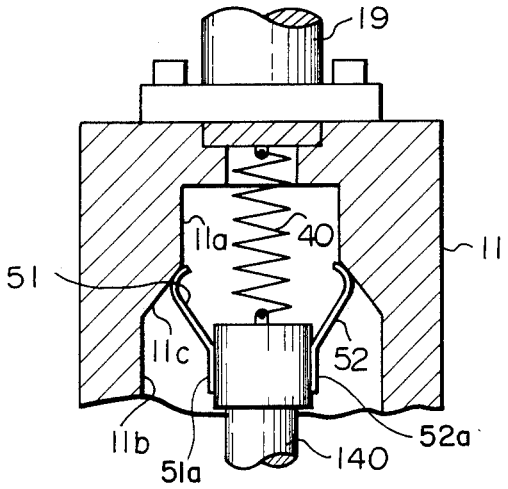
FIG. 10 is a partial longitudinal sectional view illustrating a third embodiment of the first type arrangement according to the present invention.

FIG. 10 shows a modification of the arrangement shown in FIG. 5A, wherein the restraining means comprises a tapered inner surface portion 11*c* of the valve chamber 11, and opposite resilient plates vertically extending from the top free end of the valve extension 140. The tapered portion 11*c* of the valve chamber 11 is located between an upper inner surface portion 11*a* having a shorter inner diameter and a lower inner surface portion 11*b* having a larger inner diameter, and is integrated with the upper and lower surface portions. The resilient plates 51 and 52 have intermediate portions inclined to the vertical axis of the valve extension 140 and free end portions 51*a* and 52*a* curved inwardly. These resilient plates are designed, relative to the valve chamber 11 and the valve extension 140, so that they urge themselves against the inner surface of the valve chamber 11. The resilient plates 51 and 52 are moved upwardly relative to the valve chamber 11 from the tapered surface portion 11*c* to the upper surface portion 11*a* when the valve 14 is forced to move from the first position to the second position. The resilient plates 51 and 52 are removed downwardly relative to the valve chamber 11 and abut against the tapered surface portion 11*c*, when the piston 19 is actuated to move upwardly relative to the mold, due to the resistance of the melt part solidified at the valve against the resilient force of the vertical coil spring 40.

Figure 11:
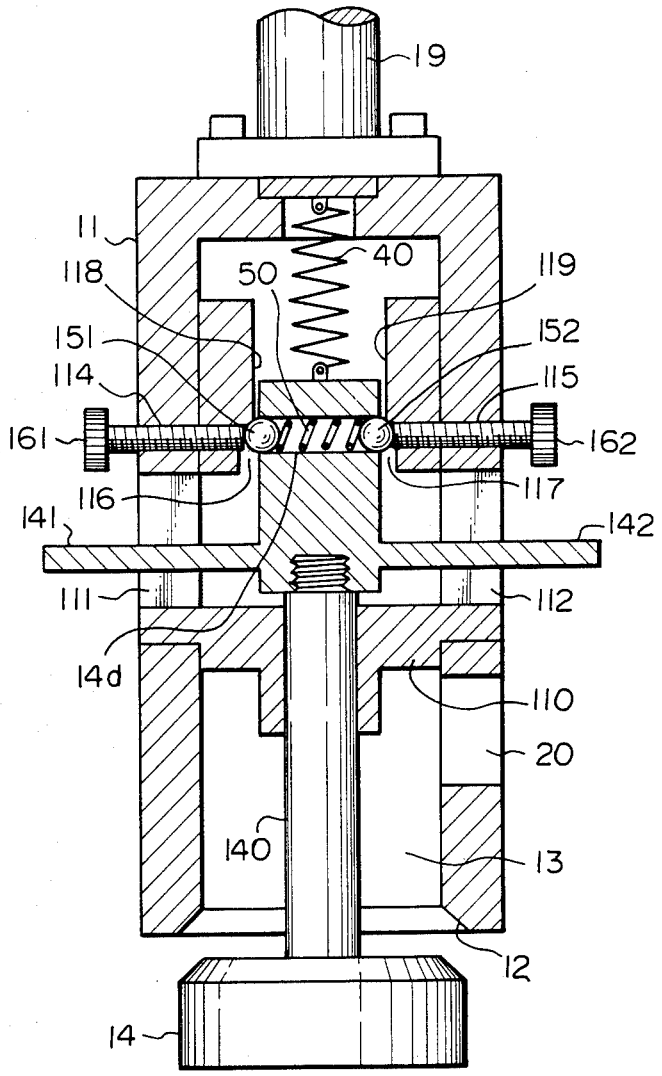
FIG. 11 is a view corresponding to FIG. 9 and illustrating a fourth embodiment of the first type arrangement according to the present invention.

FIG. 11 shows a modification of the arrangement shown in FIG. 5A, wherein the restraining means comprises a horizontal through-hole 14*d* formed in the valve extension 14 and opposite recesses 116 and 117 formed at the inner surface of the valve chamber 11, two balls 151 and 152 and a horizontally extending coil spring 50. Each ball is allowed to be rotatably received partially in the corresponding recess and is allowed to be rotatably received completely in the through-hole 14*d*. The horizontal coil spring 50 is disposed in the through-hole 14*d* in such arrangement that it is located between the balls 151 and 152, so that it urges the balls against the inner surface of the valve chamber 11 including the surfaces of the recesses 115 and 116.

The balls 151 and 152 are moved downwardly relative to the valve chamber 11 from the recesses 116 and 117 to local inner surfaces 118 and 119 of the valve chamber 11 following the upper ends of the recesses 116 and 117, when the valve 14 is forced to move from the first position to the second position. The balls 151 and 152 are moved upwardly relative to the valve chamber 11 and received in the recesses 116 and 117, when the piston 19 is actuated to move upwardly relative to the mold, due to the resistance of the melt part solidified at the valve against the resilient force of the vertical spring 40.

Bolts 114 and 115 are provided in the valve chamber 11 to define the recesses. The depth of each recess is optionally determined by screwing each bolt.

Figure 12:
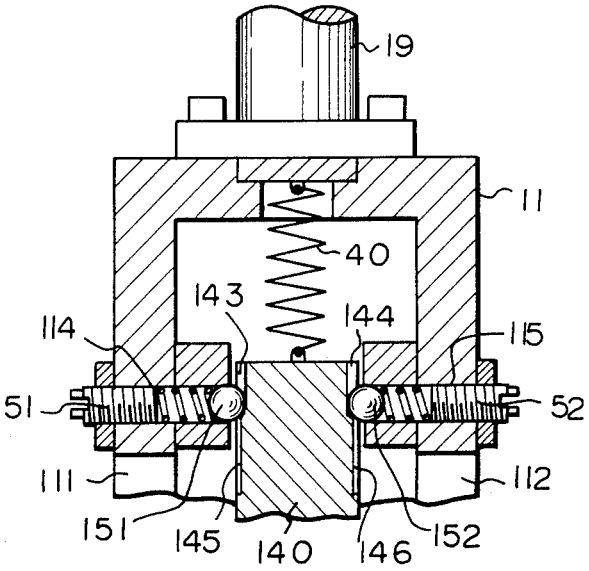
FIG. 12 is a view partially corresponding to FIG. 10 and illustrating a fifth embodiment of the first type arrangement according to the present invention.

FIG. 12 shows a modification of the arrangement shown in FIG. 5A, wherein said restraining means comprises opposite vertically longitudinal grooves 143 and 144 formed on the surface of the valve extension 140, horizontal opposite holes 114 and 115 formed in the wall of the valve chamber 11, two balls 151 and 152 and two horizontally extending coil springs 51 and 52. Each ball is allowed to be rotatably received partially in the corresponding groove 143 and 144 and is allowed to be rotatably received completely in the corresponding hole. The horizontal coil springs 51 and 52 are disposed in the corresponding holes 114 and 115, so that they urge the balls 151 and 152 against the surface of the valve extension 140 including the surfaces of the grooves 143 and 144. The balls 151 and 152 are moved downwardly relative to the valve extension 140 from the grooves 143 and 144 to the local surface 145 and 146 of the valve extension 140 following the lower ends of the grooves, when the valve is forced to move from the first position to the second position. Other opposite grooves on the valve extension 140 form the local surfaces 145 and 146. The balls 151 and 152 are moved upwardly relative to the valve extension 140 and are received in the grooves 143 and 144, when the piston 19 is actuated to move upwardly relative to the mold, due to the resistance of the melt part solidified at the valve against the resilient force of the vertical spring 40.

Figure 13:
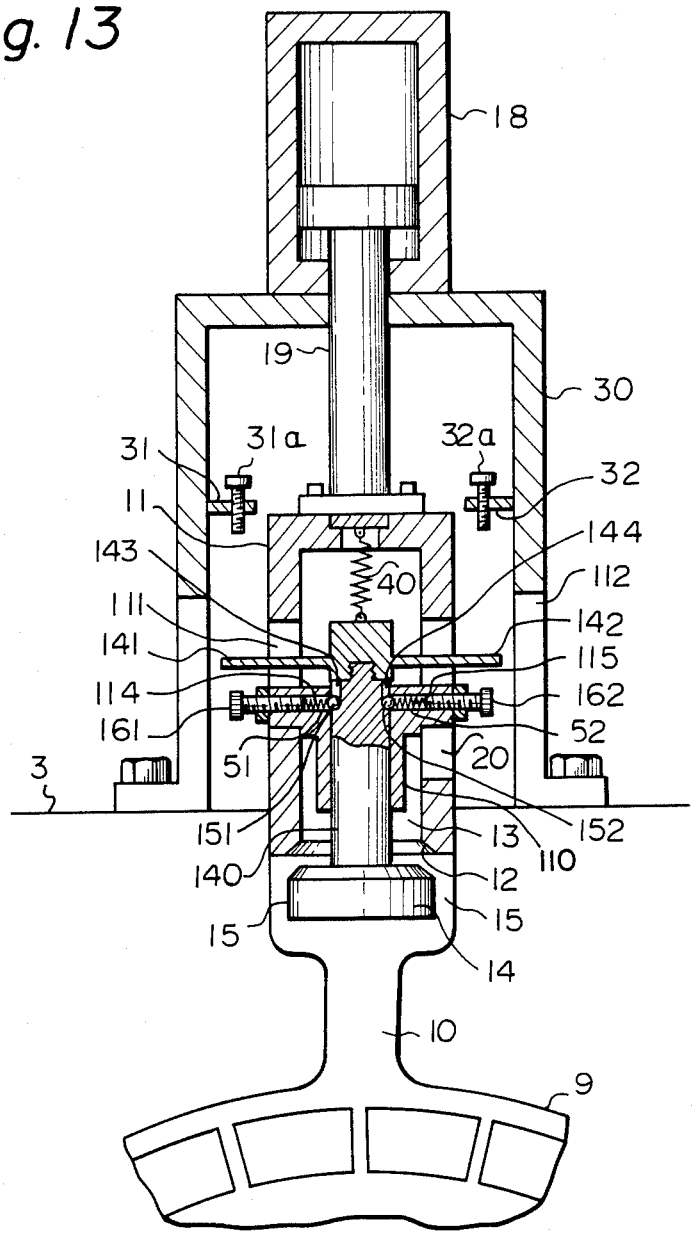
FIG. 13 is a view corresponding to FIG. 5A and illustrating a modification of the first type arrangement shown in FIG. 12.

FIG. 13 shows a modification of the arrangement shown in FIG. 12, wherein the arms 141 and 142 are positioned higher than horizontal coil springs 51 and 52, and the horizontal coil springs are located between the balls 151 and 152 and bolts 161 and 162 are disposed in the horizontal holes 114 and 115 formed in the guide 110 fixed to the valve chamber 11. The force of the horizontal coil springs 51 and 52 can be adjusted by the bolts 161 and 162. The by-pass passages 15 are defined by the gas vent passage 10 and the valve 14 received therein.

The arrangement may be provided with a plurality of pairs of grooves 143 and 144. These pairs of grooves are located spaced apart from each other around the circumference of the valve extension 140, and the lower ends of the groove pairs are in axial positions different among the pairs. The axial position of each groove pair defines the degree of the valve opening, and thus the valve 14 can be adjusted to be in different first positions. In this case, the injection operation can be carried out conveniently at different degrees of valve opening, as needed, that is, as products to be molded require.

In this embodiment, it is to be noted that the balls 151 and 152 and the horizontal springs 51 and 52 are disposed in the valve guide 110, and thus, the arrangement has an advantage in that the valve extension 140 is likely to be maintained coaxial with the valve chamber 11. This is true, even if there is somewhat of a difference between the forces of the vertical springs 51 and 52.

Figure 14:
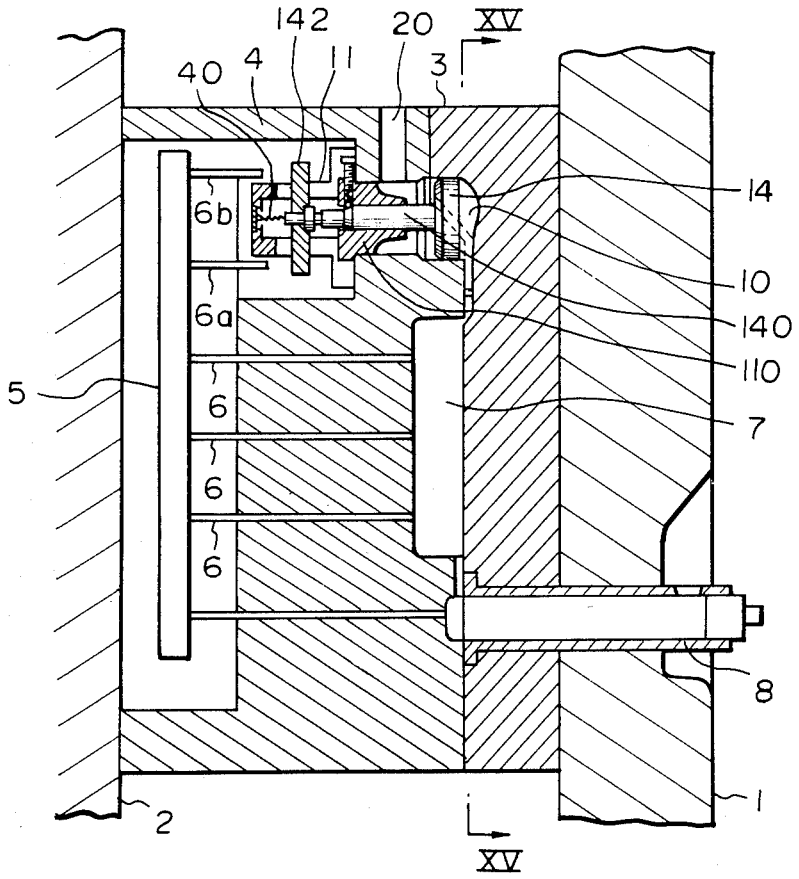
FIG. 14 is a view corresponding to FIG. 4 and illustrating a second type gas-venting arrangement incorporated with a mold, according to the present invention.
Figure 15:
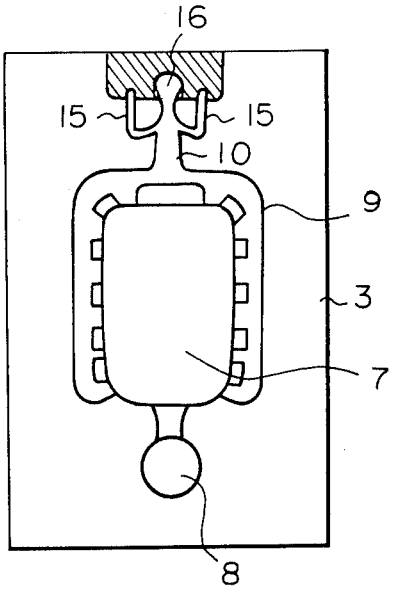
FIG. 15 is a view taken along the line XV—XV in FIG. 14.
Figure 16:
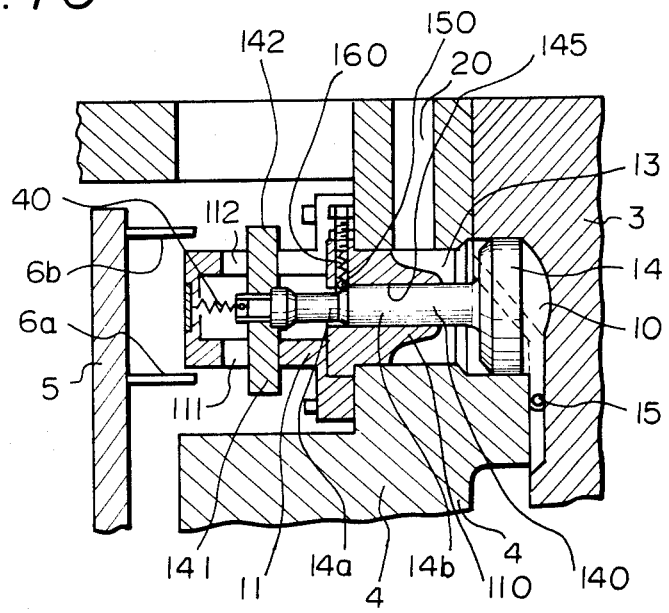
FIG. 16 is an enlarged partial view of FIG. 14.

FIGS. 14, 15 and 16 show a second type of the gas-venting arrangement, wherein a valve 14 has a horizontal axis and is mounted for horizontal movement relative to the mold. The valve 14 has a horizontal axial extension 140 extending into a valve chamber 11, which extends horizontally from the mold. That is, the valve chamber 11 is fixed to the mold by bolts. The valve extension 140 is horizontally slidable into the valve chamber 11 through a valve guide 110 disposed therein. The numeral 20 denotes a gas outlet opening to outside of the mold. The urging means comprises a vertically extending coil spring 40 corresponding to that in FIG. 5A, and connected to the free end of the valve extension 140 and to the free end of the valve chamber 11.

The restraining means comprises a constricted portion 14*a* of the valve extension 140, a hole 160 formed in an upper wall portion of the valve chamber 11, a ball 150 and a vertically extending coil 50. The constricted portion 14*a* of the valve extension defines a recess with which the ball is engageable. The ball 150 is allowed to be rotatably received partially in the recess and is allowed to be received rotatably and completely in the hole 160. The vertical coil spring 50 is disposed in the hole 160, so that it urges the ball 150 against the upper surface of the valve extension 140 including the surface of the recess.

The actuating means comprises means for pushing the valve horizontally from the second position to the first position. The pushing means comprises a push plate device provided on the mold for actuating a push plate 5 having push pins 6 to remove the molded product from the mold after the mold is opened. The push plate 5 also has two rods 6*a* and 6*b* adapted to push the valve 14. The valve extension 140 has opposite arms 141 and 142 extending vertically from the free end through horizontally extending slots 111 and 112 formed in the upper and lower walls of the valve chamber 11 and projecting from the chamber 11. The ball 150 is moved horizontally relative to the valve extension 140 from the recess to a local upper surface 145 of the valve extension 140 following the recess, when the valve 14 is forced to move from the first position to the second position. The ball 150 is moved horizontally relative to the valve extension 140 and received in the recess, when the push plate 5 is actuated so that the rods push the arms 141 and 142 of the valve extension 140.

Upon the impingement of the melt against the valve 14, the valve 14 is forced to move from the first position to the second position, and then it is restrained at the second position. This is because the engagement of the valve extension 140 with the valve chamber 11 is released, while the valve 14 is urged to move toward the second position by the coil spring 40. Therefore, even in the case of discontinuous impingement of the melt, no axial oscillation of the valve 14 occurs. The urging means and the restraining means exactly correspond to those of FIG. 12.

Figure 17:
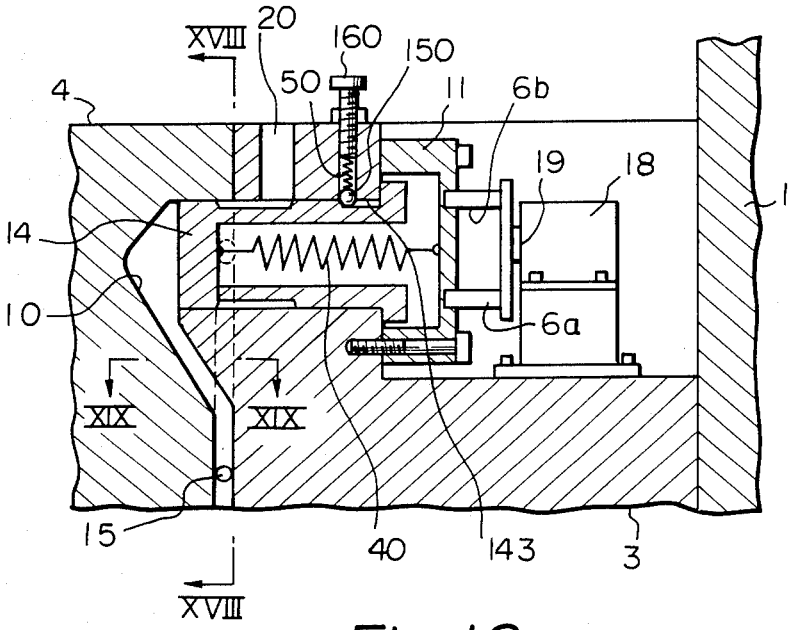
FIG. 17 is a view corresponding to FIG. 16 and illustrating a modification of the second type arrangement shown in FIG. 16.
Figure 18:
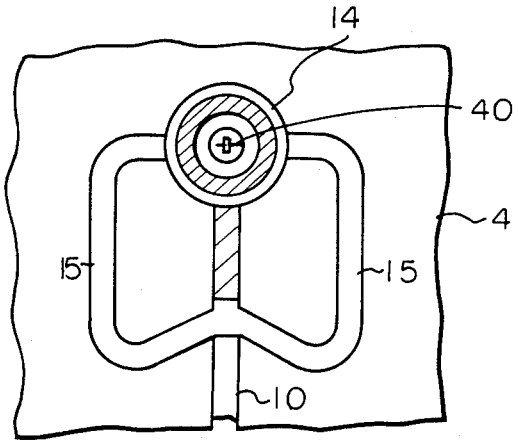
FIG. 18 is a view taken along the line XVIII—XVIII in FIG. 17.
Figure 19:
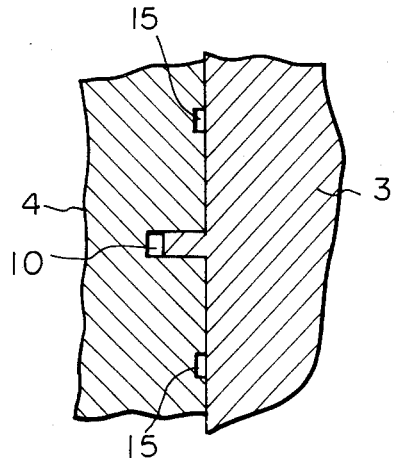
FIG. 19 is a view taken along the line XIX—XIX in FIG. 17.

FIGS. 17, 18 and 19 show a modification of the arrangement shown in FIG. 16, wherein a valve extension 140 is cylindrical, and a horizontal coil spring 40 is located within the cylindrical valve extension 140. A groove 143 formed in the upper wall of the valve 14 corresponds to the recess in FIG. 16. A push plate device is provided in place of the pushing means shown in FIG. 16. This device has a solenoid cylinder 18 for actuating a piston 19 having two rods 6*a* and 6*b* corresponding to those of the push plate 5 in FIG. 16. The rods 6*a* and 6*b* are allowed to pass through two holes formed in the free end of the valve chamber 11 and are adapted to push the free end of the valve extension 140 within the chamber 11. The urging means and the restraining means exactly correspond to those of FIG. 13.

Figure 20:
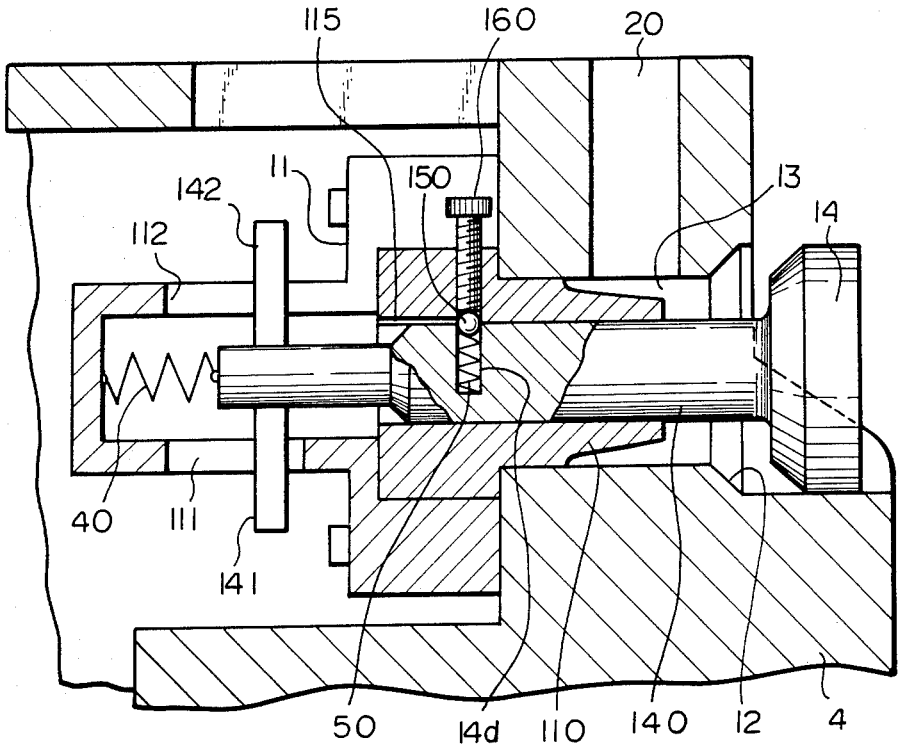
FIG. 20 is a partial longitudinal sectional view illustrating a second embodiment of the second type arrangement according to the present invention.

FIG. 20 shows a modification of the arrangement shown in FIG. 16, wherein the restraining means comprises a vertical hole 14*d* formed in a valve extension 140 to open to the upper surface, a groove 115 formed on the inner upper surface of a valve guide 110, a ball 150 and a vertically extending coil spring 50.

The ball 150 is allowed to be rotatably received partially in the groove 115 and is allowed to be rotatably received completely in the vertical hole 14*d*. The vertical coil spring 50 is disposed in the vertical hole 14*d* so that it urges the ball 150 against the surface of the groove 115. The groove 115 has a recess defined by a bolt 160 at the inner end.

The ball 150 is moved horizontally relative to the valve chamber 11 along the groove 115 therein when the valve 14 is forced to move relative to the valve chamber 11 from the first position to the second position. The ball 150 is moved horizontally relative to the valve chamber 11 and engaged with the recess at the end of groove 115, when the push plate 5 is actuated to push arms 141 and 142. When the ball 150 is received in or engaged with the recess, the valve 14 is in the first position. The bolt 160 is disposed in the valve chamber 11 and defines the recess, and thus the depth of the recess can be adjusted by the bolt. The urging means and the restraining means exactly correspond to those of FIG. 11.

Figure 21:
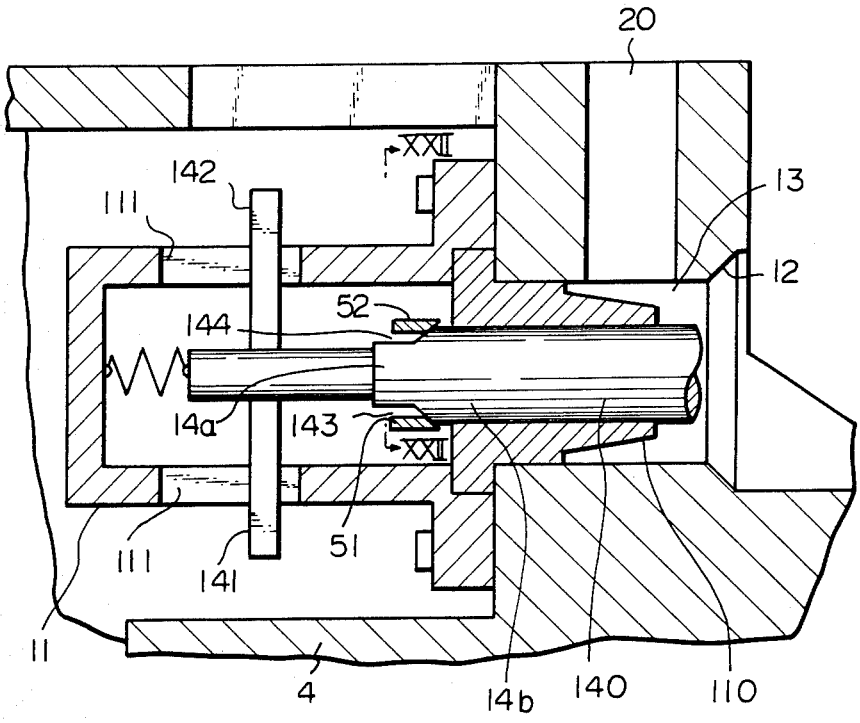
FIG. 21 is a view corresponding to FIG. 20 and illustrating a third embodiment of the second type arrangement according to the present invention.
Figure 22:
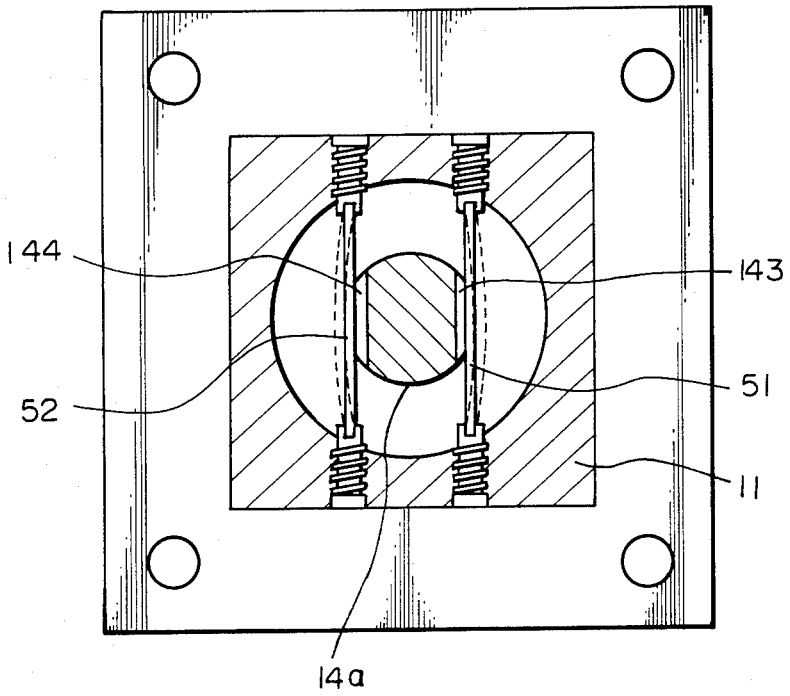
FIG. 22 is a view taken along the line XXII—XXII in FIG. 21.

FIGS. 21 and 22 show a modification of the arrangement shown in FIG. 16, wherein the restraining means comprises a portion 14*a* of a valve extension 140 constricted, in a vertical cross sectional view, which portion defines the opposite recesses 143 and 144, and opposite reslient plates 51 and 52 extending horizontally across the space of the valve chamber 11.

The resilient plates 51 and 52 are disposed in the valve chamber 11 in such arrangement that the valve extension 140 is sandwiched by the resilient plates 51 and 52, so that the resilient plates urge themselves against the surface of the valve extension including local opposite surfaces of the constricted portion. The constricted portion forms the opposite recesses 143 and 144 with which the resilient plates 51 and 52 are engageable. The resilient plates 51 and 52 are moved horizontally relative to the valve extension 140 from the constricted portion 14*a* to the local enlarged portion 14*b* of the valve extension 140 following an end of the constricted portion 14*a*, when the valve 14 is forced to move relative to the valve chamber 11 from the first position to the second position. The resilient plates 51 and 52 are moved horizontally relative to the valve extension 140 and are engaged with the constricted portion 14*a* or the recesses 143 and 144, when the pushing plates 5 are actuated so that the arms 141 and 142 are pushed by the rods 6*a* and 6*b*. The urging means and the restraining means exactly correspond to those of FIG. 5A.

Figure 23:
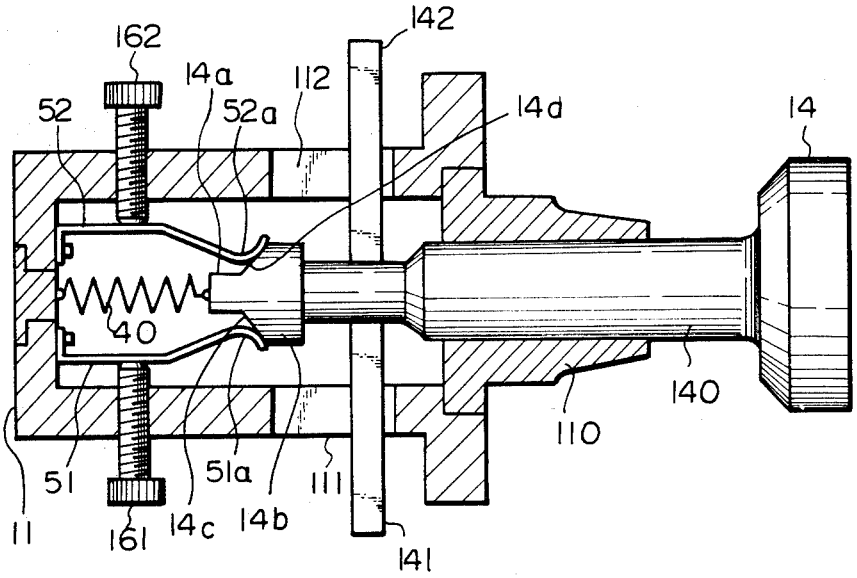
FIG. 23 is a view partially corresponding to FIG. 21 illustrating a modification of the second type arrangement shown in FIG. 21.

FIG. 23 shows a modification of the arrangement shown in FIG. 21, wherein each of resilient plates 51 and 52 is a horizontal extension from the free end of the valve chamber 11 and has a free end being curved so that opposite tapered shoulders 14*c* and 14*d* of the valve extension 140 at the constricted portion 14*a* is receptive to or engageable with the curved end 51*a* or 52*a*. The urging means and the withholding means exactly correspond to those of FIG. 9.

Figure 24:
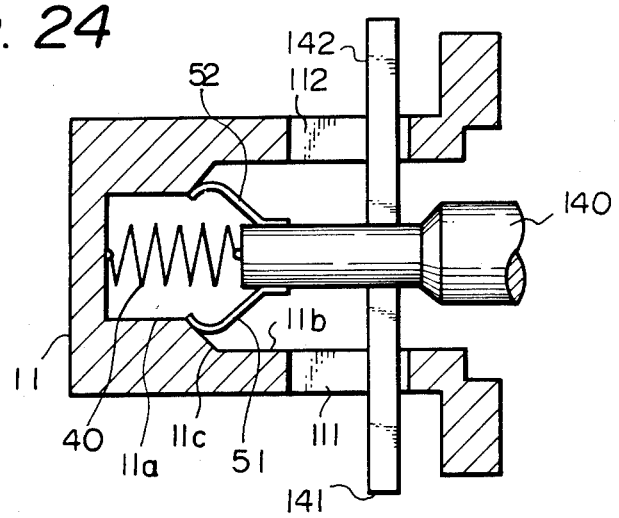
FIG. 24 is a view partially corresponding to FIG. 23 and illustrating a third embodiment of the second type arrangement according to the present invention.

FIG. 24 shows a modification of the arrangement shown in FIG. 16, wherein the restraining means comprises a tapered inner surface portion 11*c* of the valve 14 and opposite resilient plates 51 and 52 fixed at the inner ends thereof the opposite walls of the free end of the valve extension 140, respectively. The tapered portion 11*c* is located between an outer surface portion 11*a* having a shorter inner diameter and an inner surface portion 11*b* having a larger inner diameter and is integrated with the outer and inner surface portions 11*a* and 11*b*. The resilient plates 51 and 52 extend horizontally from the free end of the valve extension 140 and have intermediate portions inclined to the horizontal axis of the valve extension and free end portions curved inwardly, and are designed, relative to the valve chamber 11 and the valve extension 140, so that the resilient plates urge themselves against the inner surface of the valve chamber 11. The resilient plates 51 and 52 are moved horizontally relative to the valve chamber 11 from the tapered surface portion 11*c* to the outer surface portion 11*a*, when the valve 14 is forced to move from the first position to the second position. The resilient plates 51 and 52 are moved horizontally relative to the valve chamber and abut against the tapered surface portion 11*c*, when the push plate 5 is actuated to push the valve with the arms 141 and 142. The actuating means and the restraining means correspond exactly to those of FIG. 10.

Figure 25A:
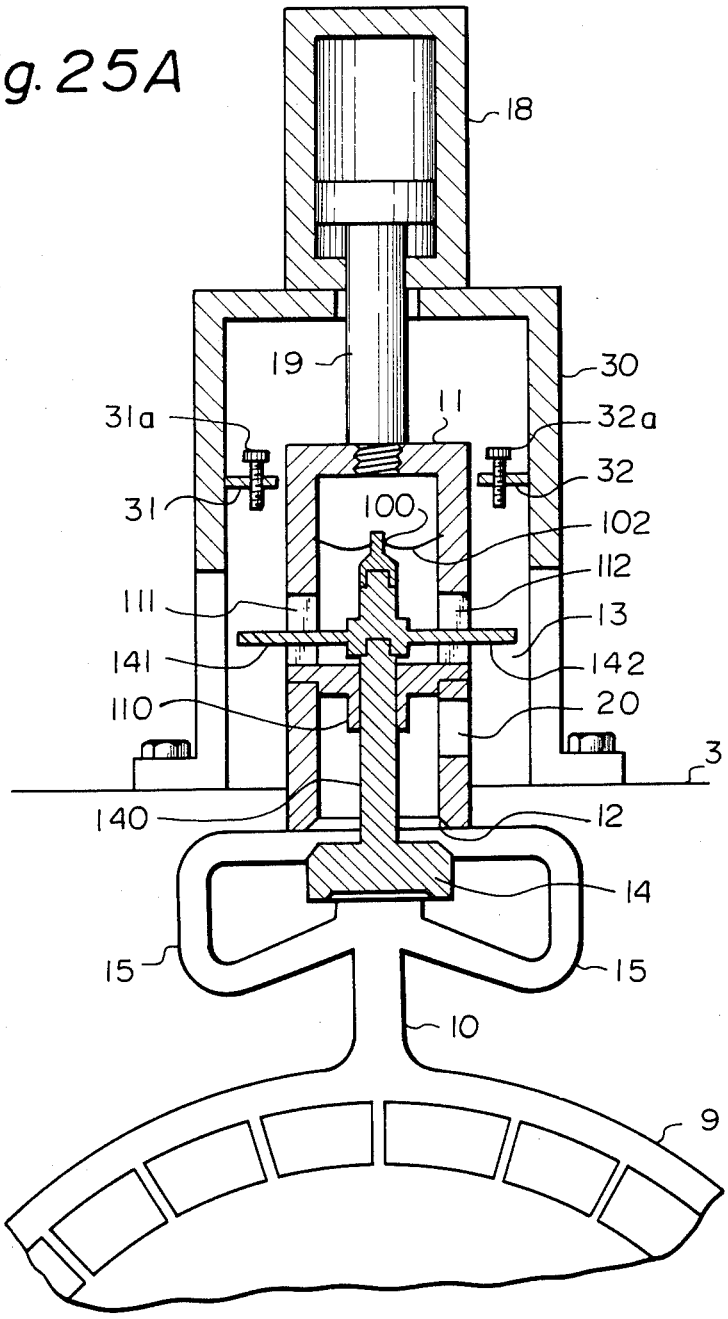
FIGS. 25A, 25B and 25C are views corresponding to FIGS. 5A, 5B and 5C and illustrating the gas-venting arrangement of a third type according to the present invention and the three stages of the casting operation in the arrangement, respectively.
Figure 25B:
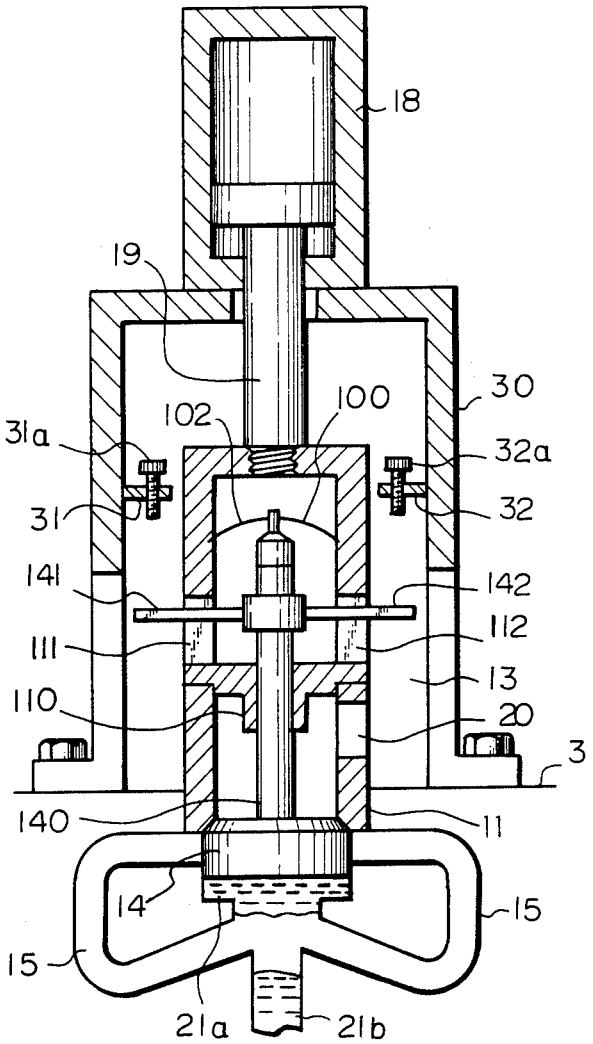
Figure 25C:
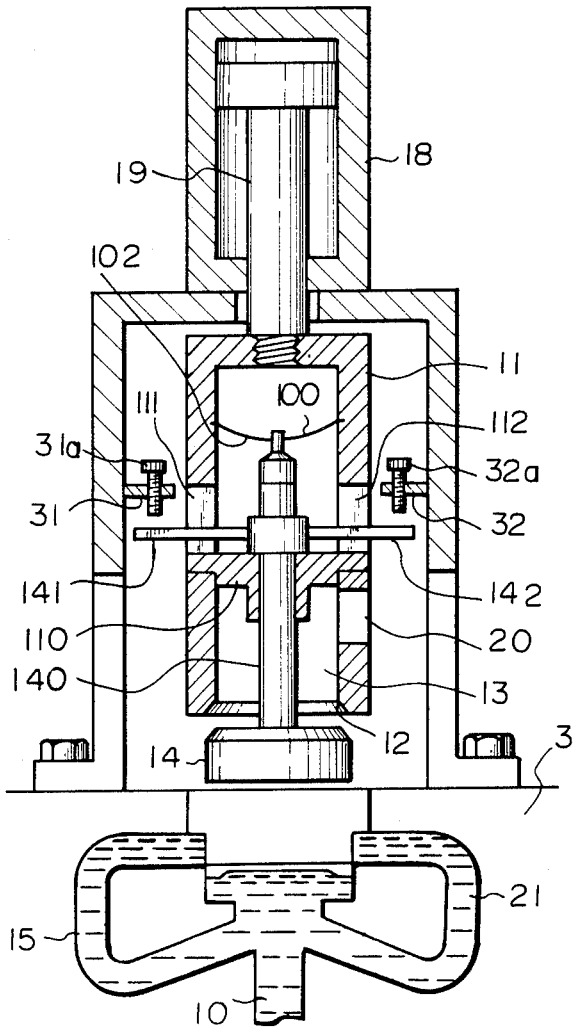
Figure 27:
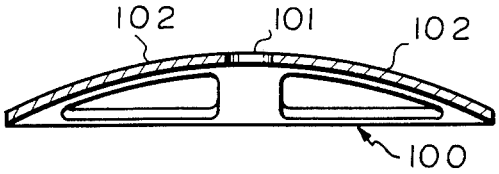
FIG. 27 is a cross sectional view taken along the line XXVII—XXVII in FIG. 26B.

FIGS. 25A, 25B and 25C, corresponding to FIGS. 5A, 5B and 5C, respectively, show a third type of the gas-venting arrangement, wherein a valve 14 has a horizontal axis and is mounted for a horizontal movement relative to the mold. The valve 14 has a vertical axial extension 140. A valve chamber 11 is a horizontal extension mounted for a vertical movement relative to the mold. The valve extension 140 is vertically slidable into the valve chamber 11 through a valve guide 110. The urging means comprises a snap-acting resilient plate 100. This resilient plate 100 extends radially from the valve extension 140 and has a central hole 101. The resilient plate 100 is connected to the inner wall of the valve chamber 11 and the top end of the valve extension 140 in such manner that the top end of the valve extension 140 is disposed in the central hole 101. The resilient plate 100 is upwardly concaved as shown in FIG. 27 in a normal state, that is, before it is secured to the valve chamber 11 and to the valve extension 140.

The restraining means comprises also the above-mentioned snap-acting resilient plate 100. The actuating means exactly corresponds to that of FIG. 5A, and thus comprises a hydraulic cylinder 18 mounted onto the mold by means of a base 30 for actuating a piston 19 in a vertical direction and the melt part 21 which impinges against the valve 14 and is solidified at the valve. The resilient plate 100 is designed so that an intermediate portion 102 of the resilient plate between the inner wall of the valve chamber 11 and the central hole 101 of the resilient plate is moved upwardly relative to the valve chamber 11 due to an upward bending of the resilient plate 100, when the valve 14 is forced to move from the first position to the second position. In this case, the central portion including the central hole 101 of the resilient plate may be upwardly moved as shown in FIG. 25B, and return to its normal state. The resilient plate 100 is bent downwardly so that the intermediate plate portion 102 is moved downwardly relative to the valve chamber 11, when the piston 19 is actuated to move upwardly relative to the mold, due to the resistance of the melt part which has been impinged against the valve and solidified at the valve, against the snap-acting force of the resilient plate 100.

Figure 26A:
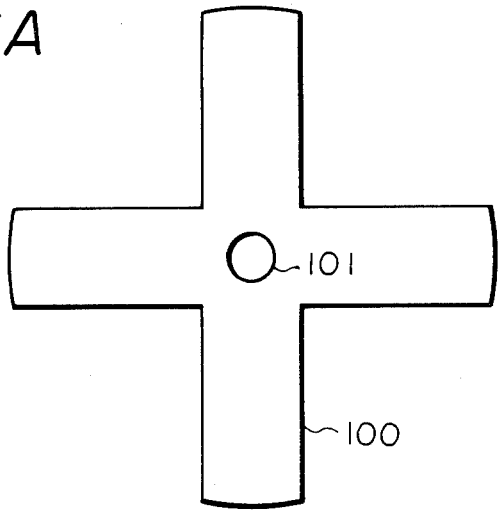
FIGS. 26A and 26B are plane views of examples of the snap-acting resilient plate to be used in the third typed arrangement.
Figure 26B:
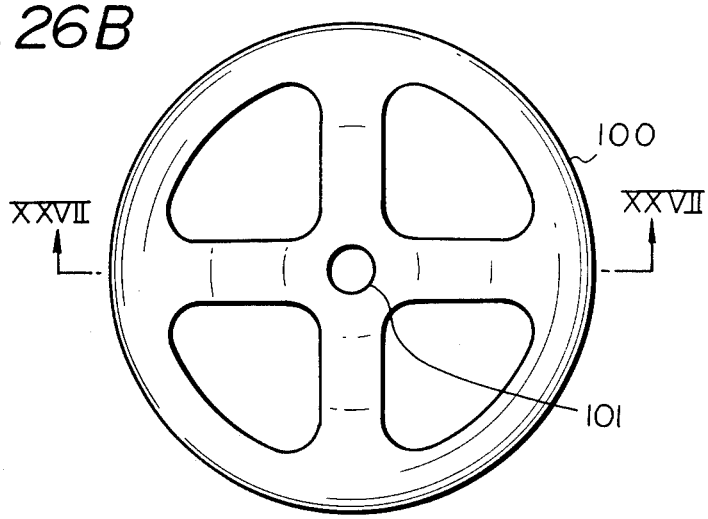

The snap-acting resilient plate 100 may preferably be of a cross shape as shown in FIG. 26A or of a handle shape as shown in FIG. 26B.

The actuating means further comprises stoppers 31 and 32 and arms 141 and 142 which are exactly the same members and are provided to exert the same functions as these of the arrangement shown in FIG. 5A.

We claim:

1. A gas-venting arrangement incorporated with a mold including stationary and movable mold halves, together defining a cavity to be filled with a melt, said gas-venting arrangement comprising:

a gas vent passage formed in said mold to communicate with said cavity;

at least one by-pass passage branched from said gas vent passage;

a gas discharge passage formed in said mold to communicate with the outside of said mold;

a valve chamber mounted for movement relative to said mold and including a valve seat communicable with said gas vent passage, by-pass passage and gas discharge passage;

valve means, including a movable valve for engagement and disengagement with said valve seat to open and close said gas vent passage, said by-pass passage and said gas discharge passage in such a manner that said valve prevents said gas vent passage from communicating with said gas discharge passage but allows said by-pass passage to communicate with said gas discharge passage, when said valve is in a first position relative to said valve chamber, and prevents said by-pass passage and said gas vent passage from communicating with said gas discharge passage, when said valve is in a second position relative to said valve chamber;

said valve including a valve extension being slidable within said valve chamber;

first means connected to said valve extension for urging said valve toward said second position, maintaining said valve in said second position, and preventing oscillation of said valve when said valve is moved from said first position to said second position;

second means for engaging a portion of said valve extension and opposing said first means sufficiently to restrain said valve from moving to said second position until an additional force acts against said valve and moves it to said second position; and third means connected to said movable valve chamber for moving said valve against the force of said first urging means from said second position to said first position;

whereby said valve during an initial molding operation is placed in the first position by said third means and restrained in that position by said second means, said valve is forced to move from said first position to said second position when a part of the melt flowing out of said cavity flows through said gas vent passage and impinges against said valve with sufficient force to overcome said second means, and said valve is maintained in said second position by said first means until the third means is activated to return said valve to said first position.

2. A gas-venting arrangement incorporated with a mold, as recited in claim 1, wherein said first means includes a vertical coil spring connected at one end to the valve extension and at the other end to the valve chamber;

said second means includes cavities on opposite inner surfaces of said valve chamber, balls individually positioned within said cavities and capable of being rotated therein, grooves formed on opposite surfaces of said vertical extension, said balls being sized for engagement with said grooves, and individual coil springs positioned within said cavities and designed to force said balls into engagement with said grooves; and said third means includes a piston connected to said valve chamber and a hydraulic or pneumatic cylinder mounted on said mold for moving said piston and said chamber relative to said mold.

3. A gas-venting arrangement incorporated with a mold, as recited in claim 1, wherein said first means includes a vertical coil spring connected at one end to the valve extension and at the other end to the valve chamber;

said second means includes a transverse bore extending through said valve extension, recesses formed along opposite sides of the inner surface of said valve chamber, said recesses positioned to correspond with said bore, a pair of balls, each of said balls capable of being rotatably positioned entirely within said bore and partially received within said recess, and a coil spring disposed within said bore and positioned between said balls, whereby said spring urges said balls into engagement with said recesses; and said third means includes a piston connected to said valve chamber and a hydraulic or pneumatic cylinder mounted on said mold for moving said piston and said chamber relative to said mold.

4. A gas-venting arrangement incorporated with a mold, as recited in claim 1, wherein said first means includes a vertical coil spring connected at one end to the valve extension and at the other end to the valve chamber;

said second means includes oppositely facing resilient plates arranged within said valve chamber for contacting the outer surface of said valve extension and constricting movement thereof; and said third means includes a piston connected to said valve chamber and a hydraulic or pneumatic cylinder mounted on said mold for moving said piston and said chamber relative to said mold.

5. A gas-venting arrangement incorporated with a mold, as recited in claim 4, wherein said resilient plates are transverse members connected to the inner walls of said valve chamber.

6. A gas-venting arrangement incorporated with a mold, as recited in claim 4, wherein said resilient plates are vertical members at the top of said valve chamber having a curved bottom surface substantially conforming to the upper portion of said valve extension.

7. A gas-venting arrangement incorporated with a mold, as recited in claim 1, wherein said first means includes a vertical coil spring connected at one end to the valve extension and at the other end to the valve chamber;

said second means includes an inner surface of the valve chamber being defined by a cylindrical lower portion, an upper portion having a narrower diameter than said lower portion, and a tapered inner surface connected therebetween, said second means also including resilient plates mounted on opposite sides of said valve extension, said resilient plates having an upwardly directed arcuate shape for contacting the inner surface of said valve chamber; and said third means includes a piston connected to said valve chamber and a hydraulic or pneumatic cylinder mounted on said mold for moving said piston and said chamber relative to said mold.

8. A gas-venting arrangement incorporated with a mold, as recited in claim 1, wherein said first means includes a snap-acting resilient plate having an upwardly concave form, said resilient plate extending radially from said valve extension and including a central aperture, said resilient plate being connected to the inner surface of said valve chamber and allowing the upper surface of said valve extension to be positioned within said aperture;

said second means comprising said snap-acting resilient plate; and said third means includes a piston connected to said valve chamber and a hydraulic or pneumatic cylinder mounted on said mold for moving said piston and said chamber relative to said mold.

9. A gas-venting arrangement incorporated with a mold, as recited in any one of claims 1 through 8, wherein said third means also comprises opposite stoppers provided in said mold for stopping the upward movement of said valve relative to said mold, said valve chamber having vertically extending slots formed in opposite side walls, said valve extension having opposite arms horizontally extending outwardly through said slots, said arms being vertically slidable in said slots, said arms and said stoppers being designed so that at a preselected point said stoppers abut against said arms to prevent said valve from moving upwardly relative to said mold while said piston is moving upwardly relative to said mold.

10. A gas-venting arrangement incorporated with a mold including stationary and movable mold halves together defining a cavity to be filled with a melt, said gas-venting arrangement comprising:

a gas vent passage formed in said mold to communicate with said cavity;

at least one by-pass passage branched from said gas vent passage;

a gas discharge passage formed in said mold to communicate with the outside of said mold;

a valve chamber fixedly positioned relative to said mold and including a valve seat communicable with said gas vent passage, by-pass passage and gas discharge passage;

valve means including a movable valve for engagement and disengagement with said valve seat to open and close said gas-vent passage, said by-pass passage, and said gas discharge passage in such a manner that said valve prevents said gas vent passage from communicating with said gas discharge passage but allows said by-pass passage to communicate with said gas discharge passage, when said valve is in a first position relative to said valve chamber, and prevents said by-pass passage and said gas-vent passage from communicating with said gas discharge passage, when said valve is in a second position relative to said valve chamber;

said valve including a valve extension being slidable within said valve chamber;

first means connected to said valve extension for urging said valve toward said second position, maintaining said valve in said second position and preventing oscillation of said valve, when said valve is moved from said first position to said second position;

second means for engaging a portion of said valve extension and opposing said first means sufficiently to restrain said valve from moving to said second position until an additional force acts against said valve and moves it to said second position; and third means for moving said valve against the force of said first urging means from said second position to said first position;

whereby said valve during an initial molding operation is placed in the first position by said third means and restrained in the third position by said second means, said valve is forced to move from said first position to said second position when a part of the melt flowing out of said cavity flows through said gas vent passage and impinges against said valve with sufficient force to overcome said second means, and said valve is maintained in said second position by said first means until the third means is activated to return said valve to said first position.

11. A gas-venting arrangement incorporated with a mold, as recited in claim 10, wherein said first means includes a coil spring connected at one end to the valve extension and at the other end to the valve chamber;

said second means includes a cavity formed in the upper surface of said valve chamber, a ball rotatably positioned within said cavity, a recess formed along a portion of said valve extension, and a second coil spring positioned within said cavity forcing said ball into engagement with said recess;

said third means being mounted on said mold, and including a slidable plate which engages said valve extension and pushes it to said first position.

12. A gas-venting arrangement incorporated with a mold, as recited in claim 11, wherein said recess is defined by a constricted portion.

13. A gas-venting arrangement incorporated with a mold, as recited in claim 11, wherein said recess is defined by an extended horizontal groove.

14. A gas-venting arrangement incorporated with a mold, as recited in claim 11, wherein said valve extension is substantially cylindrical and said second coil spring is located substantially within said cylindrical valve extension.

15. A gas-venting arrangement incorporated with a mold, as recited in claim 10, wherein said first means includes a coil spring connected at one end to the valve extension and at the other end to the valve chamber;

said second means includes a cavity formed within the upper surface of said valve extension, a ball positioned within said cavity and capable of being rotated therein, an extended horizontal groove on the surface of said valve chamber corresponding to said cavity, and a second coil spring positioned within said cavity forcing said ball into engagement with said groove; and said third means being mounted on said mold and including a slidable plate which engages said valve extension and pushes it to said first position.

16. A gas-venting arrangement incorporated with a mold, as recited in claim 10, wherein said first means includes a coil spring connected at one end to the valve extension and at the other end to the valve chamber;

said second means includes oppositely facing resilient plates arranged within said valve chamber for contacting the outer surface of said valve extension and constricting movement thereof;

said third means being mounted on said mold and including means for pushing said valve to the first position and causing said resilient plates to be moved relative to said valve extension and to engage said valve extension when said pushing means is actuated to push said valve.

17. A gas-venting arrangement incorporated with a mold, as recited in claim 16, wherein said resilient plates are extended perpendicular to the axis of said valve chamber and are connected to the inner walls thereof.

18. A gas-venting arrangement incorporated with a mold, as recited in claim 16, wherein said resilient plates are horizontal members at one end of said valve chamber having a curved free end substantially conforming to the outer section of said valve extension.

19. A gas-venting arrangement incorporated with a mold, as recited in claim 10, wherein said first means includes a coil spring connected at one end to the valve extension and at the other end to the valve chamber;

said second means includes a tapered inner surface of said valve chamber and oppositely facing resilient plates mounted on said valve extension, said resilient plates having an outwardly directed arcuate shape for contacting the inner surface of said valve chamber; and said third being mounted on said mold and including means for pushing said valve to the first position and, causing said resilient plates to move relative to said valve chamber and contact said tapered surface when said pushing means is actuated to push said valve.

20. A gas-venting arrangement incorporated with a mold, as recited in any one of claims 11 through 19 wherein said third means comprises a push plate device formed in said mold for actuating a push plate, said push plate having pins to remove the molded product from said mold after said mold is opened and at least one rod adapted to push said valve.

21. A gas-venting arrangement incorporated with a mold, as recited in any one of claims 11 through 19 wherein said third means includes at least one extending rod and at least one aperture formed in the free end of said valve chamber, said rod being positioned within said aperture and adapted to push said valve extension.

22. A gas-venting arrangement incorporated with a mold, as recited in any one of claims 11 through 19 wherein said third means includes a pair of extending rods, horizontal slots formed in said valve chamber, and a pair of arms formed on said valve extension and, individually extending through said slots, said rods being adapted to push portions of said arms extending out of said slots.

23. A gas-venting arrangement incorporated with a mold, as claimed in claims 3 or 11, wherein said valve chamber is provided with opposite bolts disposed in opposite side walls of said valve chamber, said bolts forming the surfaces of said recesses.

24. A gas-venting arrangement incorporated with a mold, as claimed in any one of claims 4, 6, 16 and 17, wherein said valve chamber is provided with opposite bolts, said bolts being disposed through the opposite side walls of said valve chamber so that said bolts abut against the outer surfaces of said resilient plates and urge said resilient plates against said valve extension, respectively.

* * * * *